US006523933B1

(12) United States Patent
Hirano et al.

(10) Patent No.: US 6,523,933 B1
(45) Date of Patent: Feb. 25, 2003

(54) MEDIA CARTRIDGE AND IMAGE RECORDING APPARATUS WITH DETACHABLY MOUNTABLE MEDIA CARTRIDGE

(75) Inventors: Hirofumi Hirano, Zama (JP); Hiroshi Nakai, Sagamihara (JP); Keiji Takahashi, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 09/656,472

(22) Filed: Sep. 6, 2000

(30) Foreign Application Priority Data

Sep. 10, 1999 (JP) ..... 11-257993
Sep. 10, 1999 (JP) ..... 11-257994
Aug. 29, 2000 (JP) ..... 2000-259123

(51) Int. Cl.[7] ..... B41J 2/165
(52) U.S. Cl. ..... 347/36
(58) Field of Search ..... 347/36, 108, 101, 347/104, 29, 30, 31, 35, 85, 86, 2; 355/18, 64; 358/296, 302, 502; 400/88, 612; 396/429

(56) References Cited

U.S. PATENT DOCUMENTS 5,221,935 A * 6/1993 Uzita ..... 347/36
5,917,518 A 6/1999 Ohashi et al. ..... 347/37
6,217,165 B1 * 4/2001 Silverbrook ..... 347/86

FOREIGN PATENT DOCUMENTS

| | | |
|---|---|---|
| EP | 0 940 455 | 9/1999 |
| JP | 55-140436 | 11/1980 |
| JP | 59-190857 | 10/1984 |
| JP | 6-15813 | 1/1994 |
| JP | 11-227957 | 8/1999 |
| JP | 11-240224 | 9/1999 |
| JP | 11-254700 | 9/1999 |

OTHER PUBLICATIONS

Australian Search Report, 2000005088–0, Seirafi, Feb. 15, 2002.

* cited by examiner

*Primary Examiner*—Michael Nghiem
*Assistant Examiner*—Shih-wen Hsieh
(74) *Attorney, Agent, or Firm*—Fitzpatrick, Cella, Harper & Scinto

(57) ABSTRACT

The present invention provides an ink jet image recording apparatus adapted for use in mobile printing, and a media cartridge for containing a sheet to be recorded by such apparatus. The media cartridge is detachably mountable on an image recording apparatus for forming an image on a sheet and includes a frame body which includes sheets for recording an image by the image recording apparatus, an ink containing member for containing ink to be supplied to an image recording unit of the image recording apparatus and to be discharged on the sheets, a pick-up unit for feeding the sheets one by one from the frame body, and an ink absorbent member for absorbing the ink not used for recording in the image recording apparatus in a state that the frame body is mounted thereon.

112 Claims, 23 Drawing Sheets

MEDIA CARTRIDGE AND IMAGE RECORDING APPARATUS WITH DETACHABLY MOUNTABLE MEDIA CARTRIDGE

BACKGROUND OF THE INVENTION

1. Field of the Invention

The present invention relates to an image recording apparatus having an ink jet recording head for recording an image by discharging ink onto a sheet constituting a recording medium, and a media cartridge detachably mountable on such apparatus.

2. Related Background Art

The ink jet image forming apparatus, for forming an image by discharging ink onto a sheet constituting a recording medium, has a high advantage in cost and is capable of easily forming a color image, and is therefore becoming popular in various imaging equipment such as a printer or a facsimile.

Also the ink jet recording apparatus, being relatively easily realized in a compact size, is also increasingly employed in so-called mobile printer of an easily portable size.

For mobile printing, there has conventionally been employed a small ink jet recording apparatus as disclosed in the Japanese Patent Application Laid-open No. 11-240224. The ink jet recording apparatus disclosed in the above-mentioned patent application is an easily portable printer, and is capable of forming an image on a sheet by connecting the apparatus to an information input device such as a personal computer.

However, such conventional technology has been associated with the following drawbacks.

A first drawback is related with the compactization of the ink jet image recording apparatus. As in the ink jet recording apparatus disclosed in the Japanese Patent Application Laid-open No. 11-240224, the ink used for forming the image on the sheet is normally contained in an ink cartridge provided in the apparatus, and, during recording the image on the sheet, is supplied therefrom to a recording head for discharging the ink, thereby recording the image.

The ink cartridge, naturally containing a large amount of ink required for forming images on several ten to several hundred sheets, occupies a large proportion within the space of the apparatus. This situation rendered it difficult to compact the ink jet image recording apparatus.

Also the ink jet image recording apparatus has to execute ink discharge not for image formation on the sheet, but for head cleaning or as preliminary ink discharge in order to ensure proper image recording. A used ink tank for receiving such discharged ink has also to be provided within the apparatus, and such fact also hinders the compactization of the image recording apparatus.

In addition the apparatus is required to be provided with rollers, a sheet tray and the like for conveying the sheets, and such members naturally increase the dimension of the apparatus.

A second drawback is related to the carriage and storage of the sheets for image recording.

In carrying the image recording apparatus, the user is required to carry also the image recording sheets, but, in the apparatus disclosed in the Japanese Patent Application Laid-open No. 11-240224, the image recording sheets have to be inserted into the apparatus one by one so that the user is compelled to execute very cumbersome operations.

The image recording operation may even fail particularly in case of continuous image formation on plural sheets. Also since there is not provided a sheet storage device for containing the sheets, the sheet may be smeared or creased and may become unsuitable for image recording while the sheets are carried by the user.

Also the sheet to be recorded by the ink jet image recording apparatus is not limited to plain paper but includes also glossy paper, coated paper, an OHP film (overhead projector sheet), seal paper etc. Particularly in case of printing a photographic image, there is often utilized a sheet having special coating.

However the sheet with such coating may become unsuitable for image recording by the smearing or peeling of the coated layer by the contact of the user or by deposition of dust, so that the sheets have to be tightly sealed rather than being simply contained.

Similarly, photosensitive sheets may be discolored or deteriorated in function upon exposure to the external light, so that there has been desired a configuration allowing to carry such sheets in a sealed state and to feed such sheets into the image recording apparatus at the image recording, without manual manipulation.

A third drawback is related to the difference in the material of various sheets employed for image recording. As explained above, the sheet to be used in the ink jet image recording apparatus is not limited to plain paper but includes also glossy paper, coated paper, an OHP film (overhead projector sheet), seal paper etc. These sheets are significantly different in the friction coefficient and the base weight, owing to the difference in the materials thereof.

For such various sheets, it is very difficult to use a common sheet feeding member or a common separating member for separating a single sheet. Thus, in the image recording apparatus having a sheet conveying member capable of conveying plain paper, a thick coated paper may result in defective conveying because of the difference in the rigidity of the sheet or in the friction coefficient.

In addition, in order to achieve satisfactory image recording without image bleeding, it is necessary to employ inks of different compositions depending on the difference in the sheet material or coating thereon, but, in the conventional ink jet image recording apparatus, it is only possible to use the same ink even when the kind of the sheet is changed or to replace the ink cartridge whenever the sheet is changed, and such method has been very inconvenient or costly to the user.

In consideration of these drawbacks, the Japanese Patent Application Laid-open No. 11-227957 discloses a sheet cartridge for a portable printer, which is mountable on and detachable from the image recording apparatus and freely portable. Such sheet cartridge allows to protect the sheets when they are carried by the user and can therefore resolve the aforementioned second drawback, but there has been no discussion of the first and third drawbacks, and the aforementioned sheet cartridge is based on the same concept as in the so-called sheet cassette or magazine and does not solve these drawbacks.

Also the Japanese Patent Application Laid-open No. 55-140436 discloses a sheet containing apparatus provided, in a cut sheet cassette containing cut sheets, with a feed roller for advancing a sheet and a separating pawl for separating a single sheet. Such sheet cassette contributes to compactization of the image recording apparatus by shifting the feeding roller from the image recording apparatus to the sheet cassette, but there has not been disclosed any configuration for reducing the dimension of the ink cartridge and the sheet cassette may inversely become bulky. Also there has not been disclosed any measure for resolving the second and third drawbacks.

The Japanese Patent Application Laid-open No. 6-15813 discloses an information processing apparatus, incorporating an ink jet image recording apparatus. In this patent application, the image recording apparatus can be incorporated in another apparatus by reducing the size of components of the ink jet image recording apparatus, but the configuration of the sheet containing apparatus is not disclosed with respect to the second drawback, and there has not been given any description on the third drawback. Consequently this invention is also incapable of resolving these drawbacks.

The Japanese Patent Application Laid-open No. 11-254700 discloses a media cartridge integrally including a sheet for image recording, an ink tank for ink supply to a recording unit, and a used ink tank for containing the used ink, for resolving the first drawback. This invention allows to compactize the image recording apparatus, by eliminating the ink cartridge and the used ink tank, which have been provided in the ink jet image recording apparatus.

Also as the media cartridge integrally contains the ink of the optimum composition for the sheet contained therein, the user can achieve appropriate recording by merely selecting the kind of the sheet, so that the usability can be improved.

However the patent application does not provide any description on the sheet feeding member or the sheet separating member depending on the material of the sheet, nor on the sealing of the sheets.

Also in the mobile printing market, it is considered important to provide an apparatus enabling re-use in consideration of the environmental issue, but the aforementioned patent applications do not provide any description nor technical concept relating to the re-use of the apparatus.

Thus, the technologies disclosed in the foregoing patent applications do not resolve all the drawbacks which the present invention intends to resolve, and there has not been provided the ink jet image recording apparatus desired in the mobile printing market.

SUMMARY OF THE INVENTION

In consideration of the foregoing, the object of the present invention is to provide an ink jet image recording apparatus adapted for use in mobile printing, and a media cartridge for containing a sheet to be recorded by such apparatus, and the present invention is featured by a media cartridge detachably mountable on an image recording apparatus for forming an image on a sheet and including a frame body which includes sheets for recording an image by the image recording apparatus, an ink containing member for containing ink to be supplied to image recording means of the image recording apparatus and to be discharged on the sheets, pick-up means for feeding the sheets one by one from the frame body, and an ink absorbent member for absorbing the ink not used for recording in the image recording apparatus in a state that the frame body is mounted thereon.

DESCRIPTION OF THE PREFERRED EMBODIMENTS

Now the present invention will be clarified in detail by preferred embodiments thereof, with reference to the accompanying drawings.

Image Forming Unit

Figure 1:
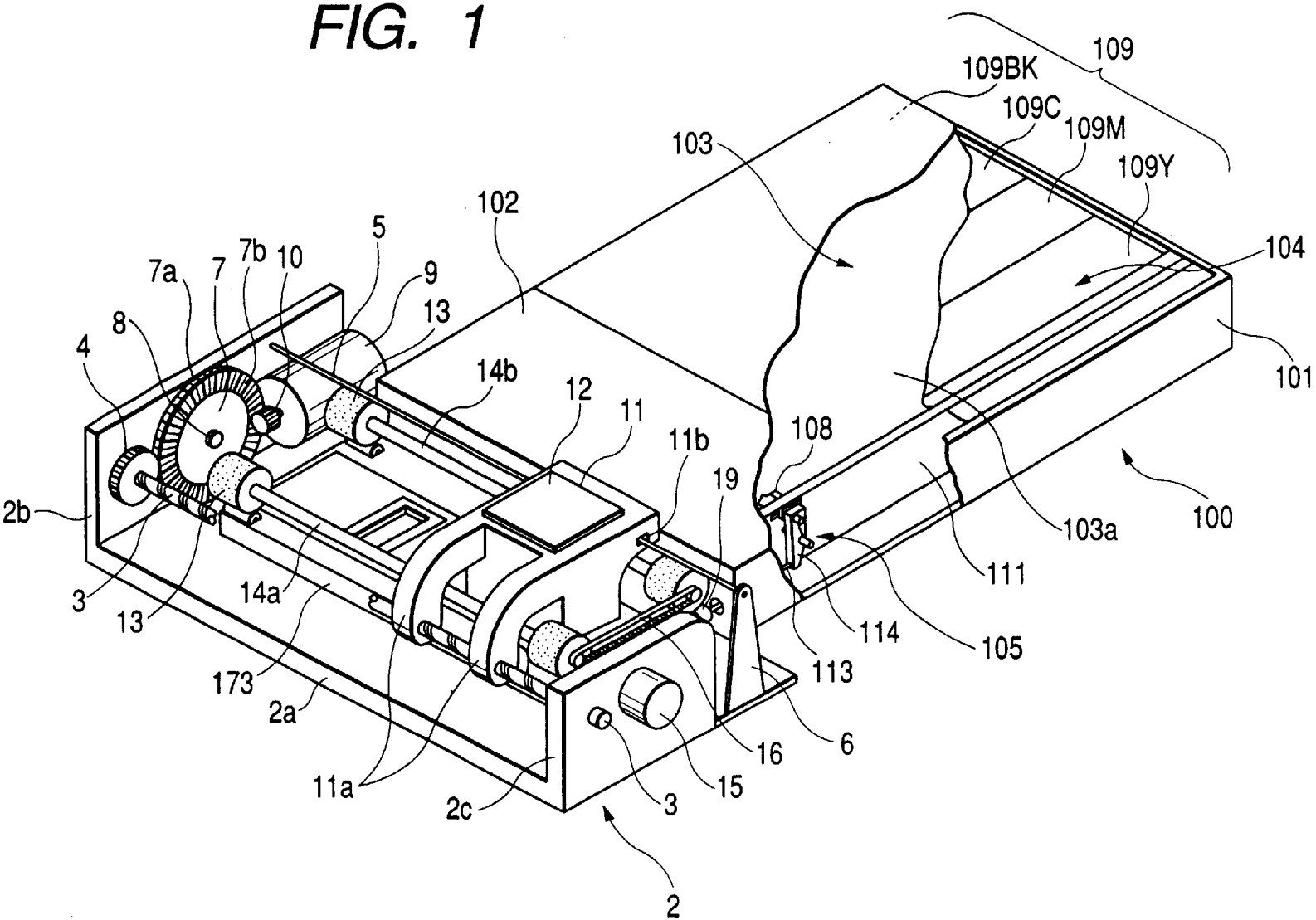
FIG. 1 is a perspective view of an image recording apparatus and a media cartridge of the present invention.

At first there will be given an explanation on the ink jet image forming apparatus. FIG. 1 is a perspective view of an ink jet image recording apparatus according to an embodiment of the present invention. Referring to FIG. 1, an image recording unit 2 constitutes the main body of the ink jet image recording apparatus. The image recording unit is provided with a base portion 2*a*, a right lateral plate 2*b* and a left lateral plate 2*c* standing on both sides of the base portion 2*a*.

The present ink jet image recording apparatus is made significantly compact by the present invention, and can be located in combination with other information equipment, such as inside the frame body of a personal computer or inside the frame body of a digital still camera. Instead of combination with other information equipment, it can naturally be constructed also as a simple printer.

A lead screw 3 is rotatably supported by the left and right lateral plates 2*b*, 2*c* and is provided with a lead gear 4 at an end thereof, specifically at the right-hand end at the side of the right lateral plate 2*b* in the present embodiment. The lead screw 3 also serves as a guide shaft for a carrier 11 to be explained later.

An idler gear 7, rotatably mounted on a rotary shaft 8 formed on the right lateral plate 2*b*, forms a spur gear 7*a* on the periphery and a face gear 7*b* in the peripheral area of a lateral face. The idler gear 7 is so positioned that the lead gear 4 meshes with the spur gear 7*a* and that the face gear 7*b* meshes with a motor pinion 10 fixed on the output shaft of a carrier motor 9 provided in the image recording unit 2. The carrier motor 9 is composed of a motor capable of forward and reverse rotations, such as a stepping motor or a DC servo motor.

A tension plate 6 stands on the base portion 2*a* of the image recording unit 2, and a guide wire 5 fixed at an end thereof to the right lateral plate 2*a* is fixed at the other end to the end portion of the tension plate 6. The guide wire 5 is composed of twisted piano wires and has flexibility with a relatively small diameter, while the tension plate 6 is composed of a material with tenacity, such as stainless steel.

A carrier 11 for supporting a recording head 12 constituting image recording means of ink jet recording method, is mounted slidably on the lead screw 3 across a guide arm 11*a* provided at an end and rotatably about the lead screw 3.

Also at an end of the carrier 11 opposite to the guide arm 11*a*, there is provided a guide portion 11*b* engaging slidably with the guide wire 5 for maintaining the posture of the carrier 11. Upon reaching a predetermined position as will be explained later, the carrier 11 is rotated about the lead screw 3 by a magnetic solenoid 51.

Figure 2:
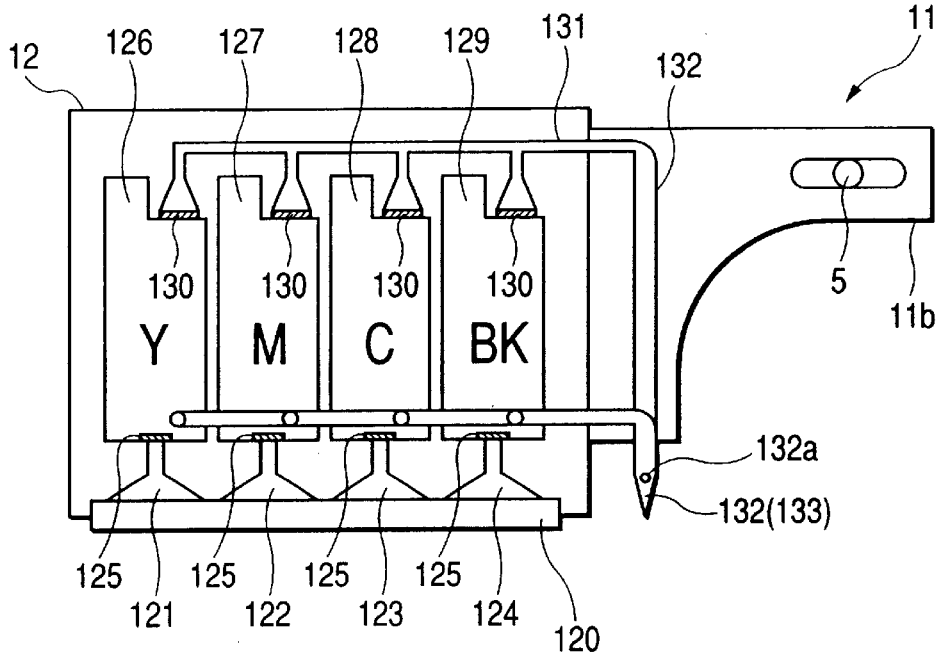
FIG. 2 is a lateral cross-sectional view showing the configuration of a recording head provided on the image recording apparatus.
Figure 3:
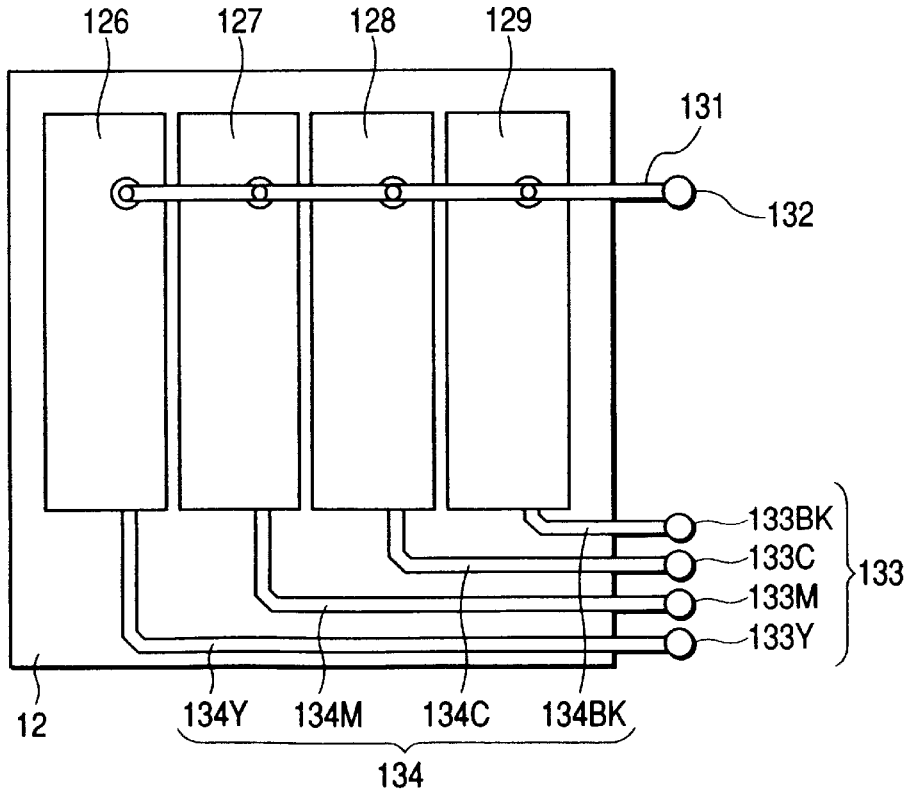
FIG. 3 is an upper cross-sectional view of the recording head.

FIG. 2 is a lateral cross-sectional view of the recording head 12 constituting the image recording means mounted on the carrier 11, and FIG. 3 is a cross-sectional plan view of the recording head 12. The recording head 12 of the present embodiment is of so-called pit-in type which executes image recording by executing ink replenishment for every printing (image recording). The image recording method by the pit-in method will be explained later.

Referring to FIG. 2, a head nozzle portion 120 is provided with unrepresented arrays of nozzles of four colors of Y (yellow), M (magenta), C (cyan) and Bk (black). There are also provided liquid chambers 121 to 124 of the inks of Y, M, C, Bk colors and ink tank chambers 126 to 129, both being arranged in the order of Y, M, C and Bk as in the case of nozzles.

There are also provided dust trapping filters 125 provided between the ink tank chambers 126 to 129 and the liquid chambers 121 to 124, and membranes 130 composed of a porous material having pores of a half to several microns, provided in the upper part of the ink tank chambers 126 to 129 and serving as full capacity valves. In each of the ink tank chambers 126 to 129 there is provided an unrepresented ink holding member with a negative pressure generating function, such as of open-pore foamed polyurethane or a laminated fibrous member.

A suction pipe 131 is provided for generating a negative pressure in the ink tank chambers 126 to 129 through a suction joint to be explained later when a negative pressure is generated by a suction pump 52 to be explained later, and communicates with a hollow suction needle 132. The suction needle 132 is pointed at the end, and is provided, on the lateral face, with a lateral hole 132*a* communicating with the internal hollow.

In FIG. 3, there are also shown a hollow supply needle 133 (133Y, 133M, 133C, 133B*k*) and an ink supply path 134 (134Y, 134M, 134C, 134B*k*). The inks of respective colors supplied from the supply needles 133 are supplied through the supply paths 134 to the ink tank chambers 126 to 129.

Referring to FIG. 1, conveying rollers 13 constituting conveying means are fixed to the both ends of conveying roller shafts 14*a*, 14*b* and are provided respectively at the upstream and downstream positions of the recording head 12. There are also shown a conveying motor 15 for rotating the conveying roller shaft 14*a*, and a timing belt 16 supported under an appropriate tension by unrepresented pulleys provided respectively on the conveying roller shafts 14*a*, 14*b*. The conveying rollers 13 are so-called LF rollers capable of step feeding of the sheet.

The driving force transmitted from the conveying motor 15 to the conveying roller shaft 14*a* is further transmitted by the timing belt 16 to the conveying roller shaft 14*b*. The rotation of the two conveying roller shafts 14*a*, 14*b* through the timing belt 16 allows synchronized rotations of such two shafts by a single sheet feeding motor 15, whereby all the four conveying rollers 13 can be rotated with a same speed and at a same timing.

Figure 4:
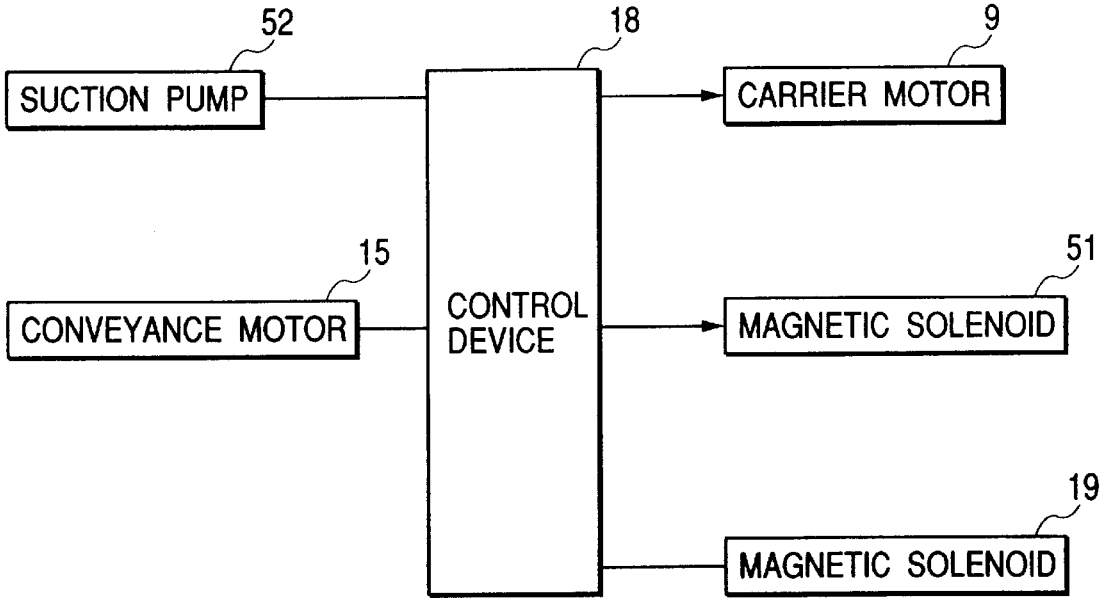
FIG. 4 is a control block diagram of the image recording apparatus.

FIG. 4 is a control block diagram of the image recording apparatus, wherein a control portion 18 controls the function of the image recording apparatus. The control portion 18 activates a magnetic solenoid 19 according to an image recording command to feed the sheet 1 and also activates a conveying motor 15 thereby conveying the sheet 1. Also it rotates the carrier motor 9 in a predetermined direction for rotating the lead screw 3 thereby moving the carrier 11 and executing image recording on the conveyed sheet 1.

Media Cartridge

Figure 5:
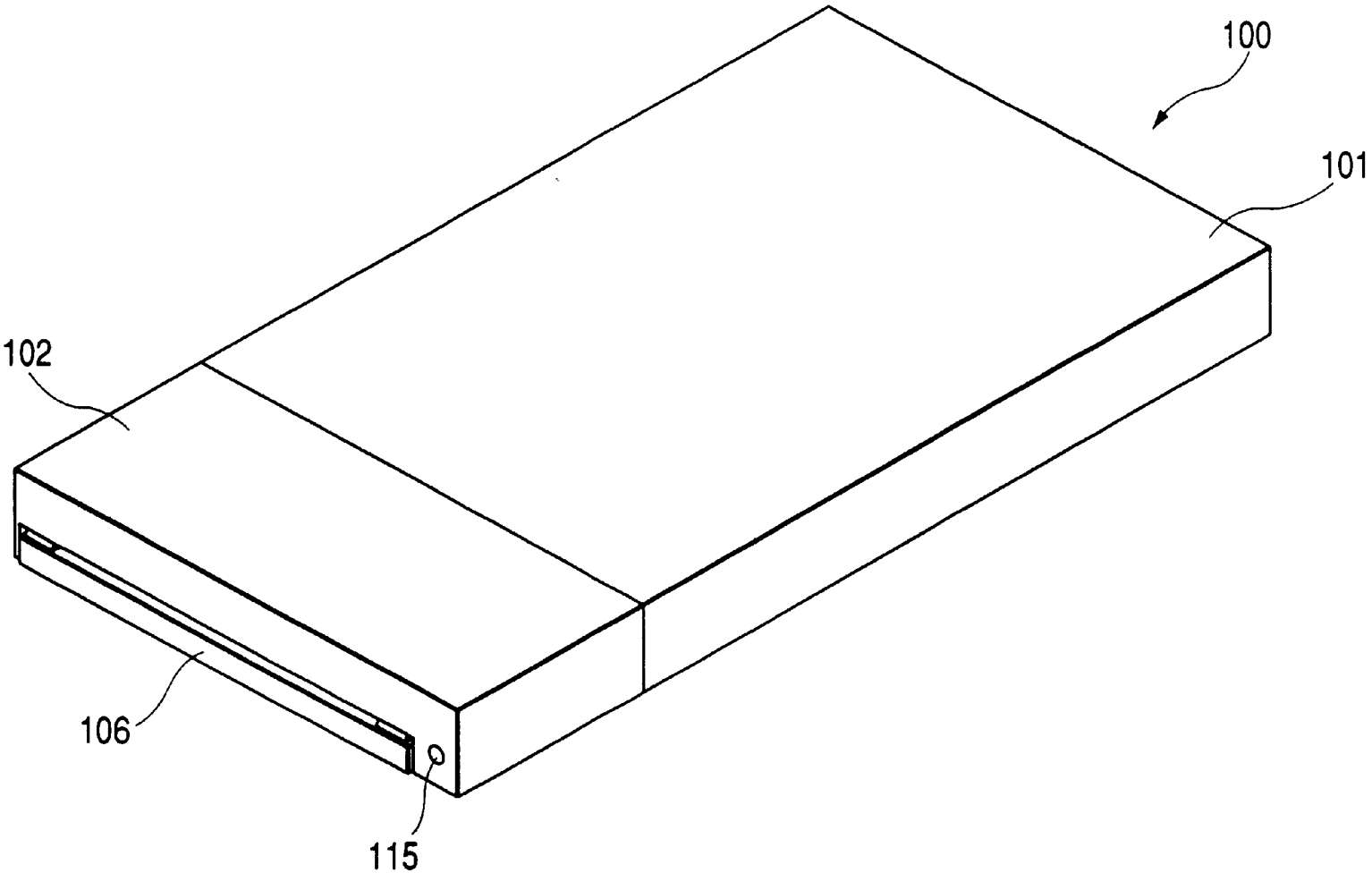
FIG. 5 is a perspective view of the media cartridge in a state not mounted on the image recording apparatus.
Figure 6:
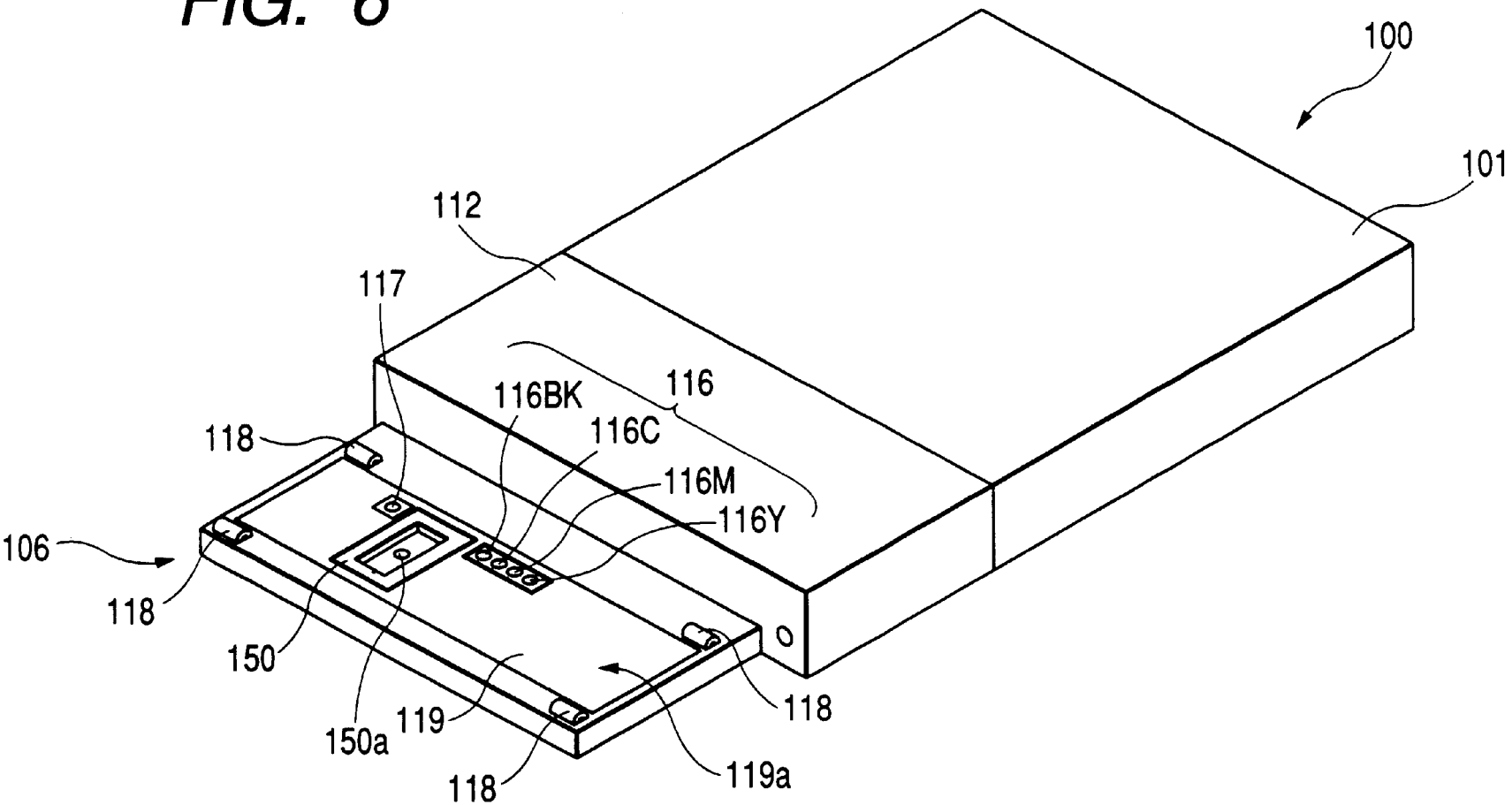
FIG. 6 is a perspective view of the media cartridge in a state mounted on the image recording apparatus.

In the following there will be given a detailed description on the media cartridge constituting an important configuration of the present invention. In FIGS. 1, 5 and 6, there is shown a media cartridge 100 detachably mountable in a mounting portion provided in the above-described ink jet image recording apparatus. The media cartridge is composed of a frame body 101 for containing media and various components to be explained later. The frame body 101 is provided with a slidable shutter member 102 which will be explained later.

Inside the frame body 101, there are provided a sheet containing portion 103 for containing sheets serving as recording media, an ink containing portion 104 for containing an ink bag 109 serving as an ink containing member which contains ink to be discharged onto the sheet by the aforementioned recording head 12, pickup means 105 for separating and advancing a sheet contained in the sheet containing portion 103, and an exposed portion 106 to be covered by the shutter member 102 in a state not mounted on the image recording apparatus but to be inserted below the recording head 12 and exposed by a sliding motion of the shutter member 102 by the engagement with the main body of the image recording apparatus in state mounted thereon. In the following the configuration of each portion will be explained in detail.

<Sheet Containing Portion>

The sheet containing portion 103 can contain plural sheets 1, and the sheets can be replenished when they are used up. The upper face and the transversal lateral faces of the sheets 1 contained in the sheet containing portion 103 are prevented from movement therein by a limiting guide 107 (cf. FIG. 24). The limitation on the upper face of the sheets presses the lowermost sheet downwards, thereby facilitating the separating function of a separating portion 110 to be explained later.

The leading end side of the sheets 1 in the feeding direction impinges on an impinging face 110*a*, serving as a pickup portion 105 to be explained later, by the entire leading end of the sheet or a part thereof, whereby the sheets are prevented from movement in the feeding direction thereof. In the present embodiment, the sheet containing portion 103 can contain 20 sheets at maximum.

In the present embodiment, the size of the sheets is selected substantially equal to the size of a visiting card, but the number and size of the sheets are not limited to those in the present embodiment but can be suitably selected according to the requirements for the apparatus.

<Ink containing portion>

In a lower portion partitioned by a sheet supporting plate 103*a* (cf. FIG. 25) supporting the lowermost sheet of the aforementioned sheet containing portion 103, there is provided an ink containing portion 104 for containing ink to be supplied to the recording head 12 constituting the image recording means for forming a record on the sheet 1.

The ink containing portion 104 can contain a flexible ink bag 109 serving as an ink containing member in which the ink is sealed, and plural ink bags 109 respectively containing inks of different compositions are arranged in the transversal direction of the sheet. The sheet supporting plate 103*a* has a function of stacking sheets thereon and a protective function for the ink bags 109 contained in the ink containing portion.

In the present embodiment, there are employed four inks of yellow 109Y, magenta 109M, cyan 109C and black 109Bk colors, and the ink bags 109 are correspondingly provided.

The kinds of the inks contained in the ink containing portion 104 are not limited to the foregoing. For example, it is possible to use three colors only of yellow, magenta and cyan and to reproduce black color by mixing these three colors. From the standpoint of reducing the dimension of the apparatus and the media cartridge, the three-color configuration based on yellow, magenta and cyan colors is advantageous. It is also possible to employ ink of a single color only, or to adopt liquid for coating the recorded surface on which the ink is discharged.

The amount of the ink contained in the ink containing portion 104 is necessary and sufficient for forming images on the sheets of a maximum number to be contained in the sheet containing portion 103. The media cartridge 100 is so constructed as to enable replacement of the ink bags 109 or replenishment of ink only.

<Pickup Portion>

The pickup portion 105, serving as pickup means for advancing the sheets one by one from the frame body 101 to the exterior thereof in succession from the lowermost one of the sheets containing in the sheet containing portion 103, is provided with a sheet feeding member 108 for contacting the lowermost sheet 1, in the direction of gravity, of the stacked plural sheets and advancing such sheet toward the exposed portion 106, and a separating portion 110 for separating a lowermost single sheet among the sheets advanced by the sheet feeding member 108.

Figure 7:
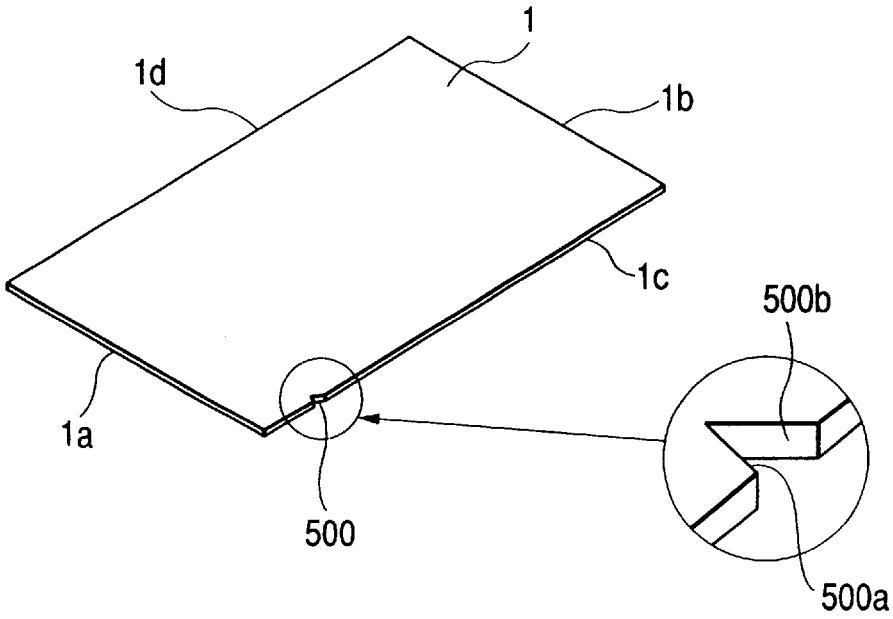
FIG. 7 is a perspective view of a sheet to be contained in the media cartridge.

As shown in FIG. 7, the sheet 1 has a leading edge 1*a* at the feeding side, a trailing end 1*b*, a left side edge 1*c* at the left side parallel to the sheet feeding direction, and a right side edge 1*d* at the right side.

Figure 8:
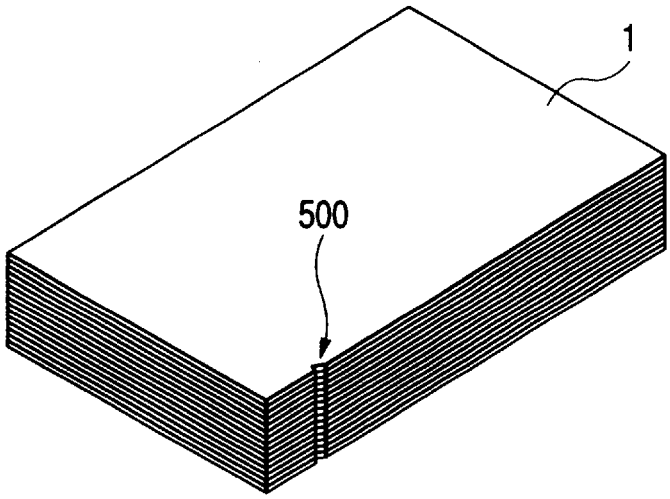
FIG. 8 is a perspective view of sheets showing the state thereof in the media cartridge.

The left side edge 1*c* of the sheet 1 is provided with a notch 500 constituting an engaging portion of a depth of about 0.5 mm. The notch 500 is provided with a feeding side 500*a* perpendicular to the sheet feeding direction and a tapered side 500*b*. In the sheet containing portion 103, the sheets 1 are stacked in a state that the notches 500 mutually coincide as shown in FIG. 8.

Figure 9:
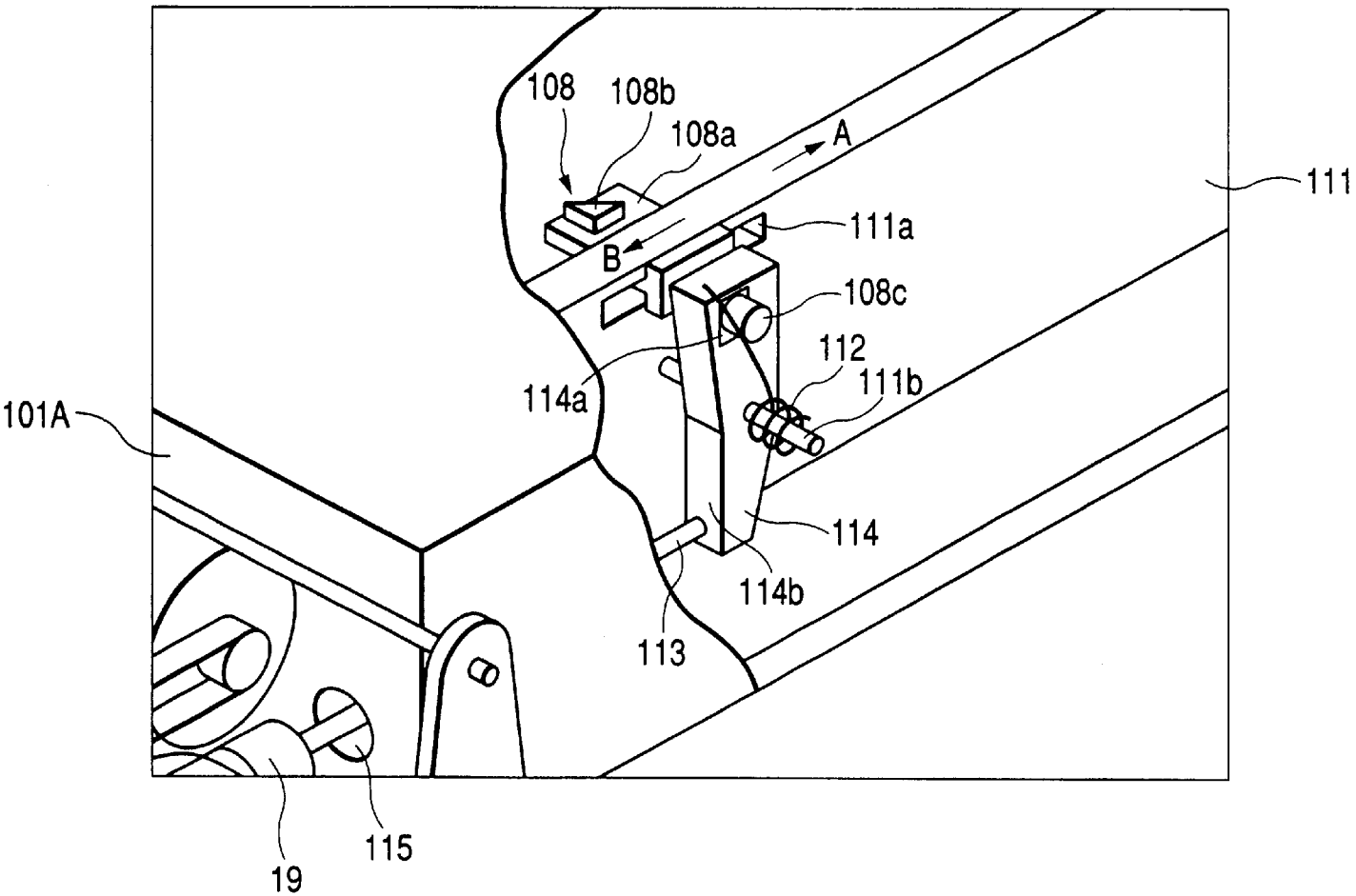
FIG. 9 is a perspective view showing the configuration of a pickup unit for feeding the sheet.

FIG. 9 shows the configuration of a sheet feeding member 108 provided in the media cartridge 100 for feeding the sheet 1, utilizing the notch 500 formed therein.

Referring to FIG. 9, a notch joint 108 serving as a sheet feeding member is provided with a sheet receiver 108*a* for supporting the sheet 1 from below and constituting a plane common with an unrepresented sheet stacking plate provided horizontally in the media cartridge 100 so as to stack the sheets 1, and an engaging pawl 108*b* protruding from the sheet receiver 108*a* and adapted to engage with the notch 500 of the sheet 1, and is slidably mounted on a guide hole 111*a* provided in a lateral wall 111 standing in the media cartridge 100 for limiting the lateral face of the sheets.

The notch joint 108 is provided in a space between the lateral wall 111 and the frame body 101. In the present embodiment, the notch joint 108 is positioned at the side of the exposed portion 106 within the frame body 101, namely at the side of the leading end of the sheet. Such configuration is advantageous for facilitating the drive of the notch joint 108 as will be explained later and for improving facility and reliability of the sheet advancing operation, but the present invention is not limited to such configuration and may also adopt a configuration in which the notch 500 and the notch joint 108 are provided at the side of the trailing end of the sheet.

In case of setting the sheets 1 in the sheet containing portion 103, the sheets 1 are placed on the sheet receiving plate and the sheet receiver 108*a* while the notch 500 engages with the engaging pawl 108*b* of the notch joint 108.

In the present embodiment, the height of the engaging pawl 108*b* is selected somewhat lower than the thickness of the sheet 1 whereby the engaging pawl 108*b* engages only with the notch 500 of the lowermost sheet 1 among the stacked sheets. Thus, the lowermost sheet 1 alone is advanced by moving the engaging pawl 108*b* in the sheet feeding direction while the engaging pawl 108*b* engages only with the notch 500 of such lowermost sheet 1.

An action lever 114 for activating the notch joint 108 is rotatably mounted on a shaft 111*b* provided on the lateral wall 111, and is provided, in an upper end portion, with a square hole 114*a* engaging with an action shaft 108*c* protruding from the lateral face of the notch joint 108 and, at the other end, with an action face 114*b*.

A compression torsion spring 112, wound on the shaft 111*b* and engaging at an end with the frame body 101 and at the other end with the action shaft 108*c*, biases the notch joint 108 through the action shaft 108*c*, toward a direction (indicated by an arrow A) opposite to the feeding direction. Owing to such biasing by the compression torsion spring 112 in the direction A opposite to the feeding direction, the notch joint 108 returns to the original position after the feeding of the sheet 1 in a sheet feeding operation to be explained later.

Also the compression torsion spring 112 has a coil portion with a gap in the coil as in the ordinary compression spring, and therefore functions to press the action lever 114 toward the lateral wall 111.

By such pressing of the action lever 114 toward the lateral wall 111, the notch joint 108 is also biased by the compression torsion spring 112, serving as the biasing means, through the action lever 114 toward the sheet 1, whereby the engaging pawl 108*b* is also biased in a direction engaging with the notch 500 of the sheet 1.

As will be explained later, after the engagement with the notch 500 is released at the sheet feeding, the engaging pawl 108*b* is brought into contact under pressure with the sheets 1 (left side edge 1*c*) by the compression torsion spring 112.

An action shaft 113 is provided in the main body of the image recording apparatus and functions as drive means for rotating the action lever 114. An end of the action shaft 113 passes through a hole 115 provided in a front wall 101A of the frame body 101 and is maintained in contact with an action face 114*b* of the action lever 114, while the other at the side of the main body of the image recording apparatus is mounted on a push-pull magnetic solenoid 19 serving as drive means. When the solenoid 19 is energized, the action shaft 113 moves toward the action lever 114 whereby the action lever 114 rotates against the spring force of the compression torsion spring 112.

When the action lever 114 is thus rotated, the notch joint 108 of which the action shaft 108*c* engages with the square hole 114*a* of the action lever 114 moves in the feeding direction (indicated by an arrow B) in a state in which the engaging pawl 108*b* is in engagement with the notch 500 of the sheet 1, thereby feeding the sheet 1. When the magnetic solenoid 19 is deactivated, the action shaft 113 moves in the opposite direction, whereby the action lever 114 returns to the original position by the spring force of the compression torsion spring 112.

A separating portion 110 is of a slit separation type, provided with an aperture (slit) 110*b* (cf. FIGS. 13A and 13B) allowing passage of the lowermost sheet and an impingement portion 110*a* for inhibiting the movement of other sheets. The impingement portion 110*a* utilizes a part of the sheet containing portion 103 and limits the movement of the sheets in the longitudinal direction by the impingement of the leading end portion of the sheet in the feeding direction. In the present embodiment, the aperture 110*b* and the impingement portion 110*a* are formed in a part of the transversal width of the sheet, more specifically at the side of the sheet feeding member 108, but they may be provided over the entire width of the sheet.

<Exposed Portion>

As shown in FIGS. 1, 5 and 6, an exposed portion 106 is provided, in the frame body 101 of the media cartridge 100, at the downstream side of the sheet containing portion 103 and the pickup portion 105 in the sheet feeding direction. As explained in the foregoing, the frame body 101 is provided with a shutter member 102 for covering the exposed portion 106, and the shutter member 102 covers and protects such exposed portion 106 in a state where the media cartridge 100 is not mounted on the image recording apparatus, and, in such state, the media cartridge 100 assumes a substantially rectangular shape.

When the media cartridge 100 is mounted on the image recording apparatus, a shutter releasing mechanism provided in a mounting portion of the image recording apparatus engages with the shutter member 102 to cause a sliding motion thereof toward the sheet containing portion 103, thereby exposing the exposed portion 106. The exposed portion 106 in such exposed state is inserted vertically below the recording head 12.

In the exposed portion 106, there are provided supply joints 116 (116Y, 116M, 116C, 116B*k*) connected with the ink bags 109 (109Y, 109M, 109C, 109B*k*), and a suction joint 117 connected with a suction pump 52.

These joints 116, 117 are so positioned, when the media cartridge 100 is mounted on the image recording apparatus to expose the exposed portion 106 by the sliding motion of the shutter member 102, as to respectively oppose to supply needles 133 and a suction needle 132 provided in the carrier 11. The positions of the joints 116, 117 in the exposed portion 106 are to be determined according to the positions of the supply needles 133 and the suction needle 132 provided in the carrier 11 and are not limited to the positions in the present embodiment.

The joints 116, 117 are composed of thin rubber membranes and, when they are pierced by the supply needles 133 and the suction needle 132 by the rotation of the carrier 11, the hollow portions of the needles 132, 133 communicate with the ink bags 109 or the suction pump 52. When the needles 132, 133 are extracted, the holes are closed by the elastic property of rubber, thereby preventing evaporation of the inks.

Figure 10A:
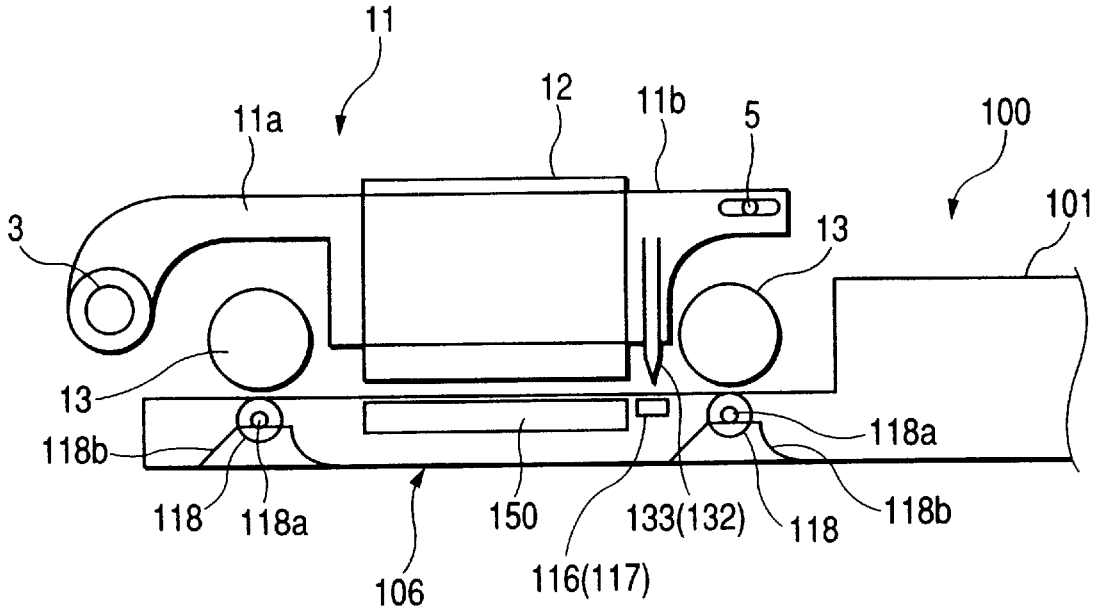
FIG. 10A is a schematic lateral view of a state in which the media cartridge is mounted on the image recording apparatus.
Figure 10B:
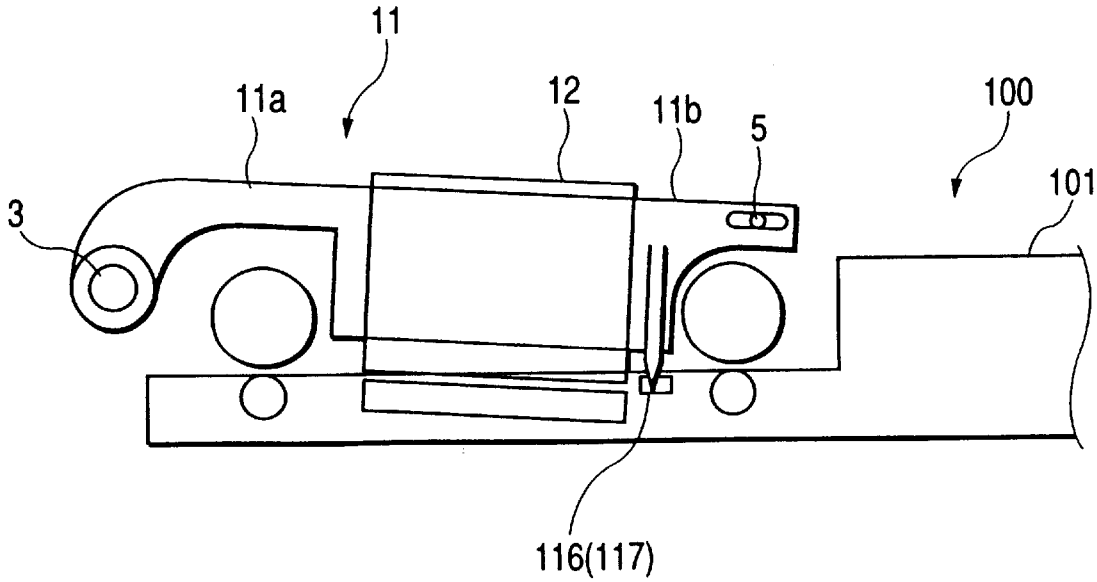
FIG. 10B is a schematic lateral explanatory view showing an ink replenishing operation of the image recording apparatus.

In the corner portions of the exposed portion 106, there are rotatably mounted pinch rollers 118 for containing conveying rollers 13 at the mounting of the media cartridge 100 thereby constituting conveying means in cooperation with the conveying rollers 13. The pinch rollers 118 are biased by a predetermined force upwards, namely toward the conveying rollers 13, by pinch roller springs 118*b* constituting roller biasing means in contact with roller shafts 118*a* as shown in FIGS. 10A and 10B.

Thus, when the media cartridge 100 is mounted on the main body of the image recording apparatus, each pinch roller contacts the conveying roller 13 under a predetermined pressure. Stated differently, the exposed portion 106 of the present embodiment serves as a platen for supporting the sheet 1 at the image recording region.

Figure 15:
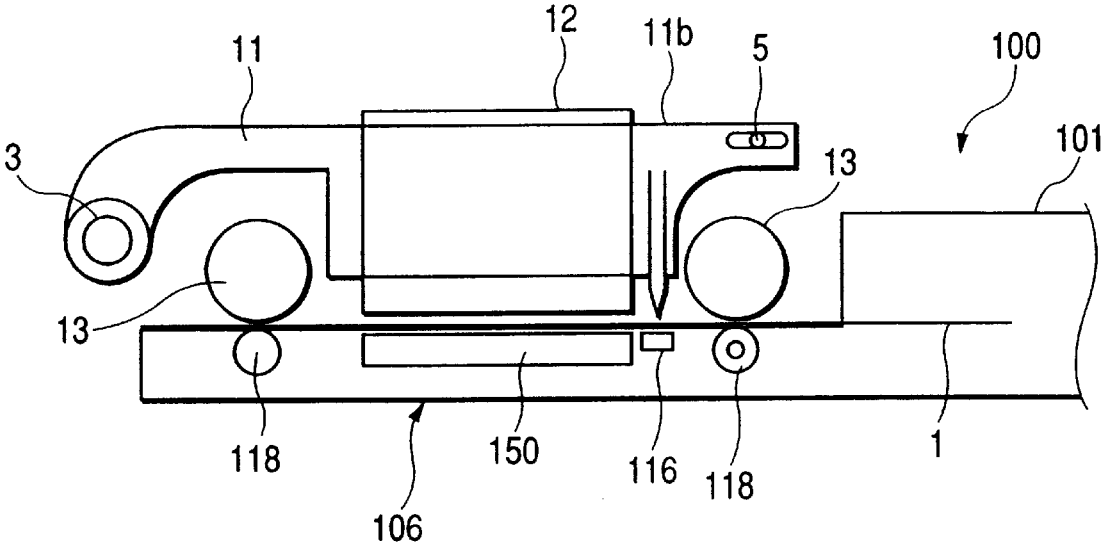
FIG. 15 is a schematic cross-sectional view showing a state in which the image is recorded at a central portion of the sheet.

The conveying rollers 13 serving as conveying means in the main body of the image recording apparatus are so constructed as to substantially linearly convey the sheet advanced from the media cartridge 100 (cf. FIG. 15).

The spring pressure of the pinch roller springs 118*b* is so selected as to press the pinch rollers 118 to the conveying rollers 13 with a pressure corresponding to the thickness or material of the sheet 1 contained in the media cartridge 100. Such contact of the pinch rollers 118 with the conveying rollers 13 under such pressure allows to properly convey the sheet 1 without slippage or jamming.

Also because the pinch rollers 118 are provided in the exposed portion 106, if the sheet 1 is jammed between the pinch rollers 118 and the conveying rollers 13, the pinch rollers 118 can be separated from the conveying rollers 13 by detaching the media cartridge 100. In this manner the jam process can be easily executed.

Also, in a state that the media cartridge 100 is mounted on the image recording apparatus, the exposed portion 106 is positioned vertically below the aforementioned recording head 12, and such exposed portion 106 is provided, on the upper surface thereof, with an ink absorbent member 119 of a porous material obtained by sintering powder of an ink absorbent material, in an ink absorbent member containing portion 119*a*.

Owing to the presence of the ink absorbent member 119 on the upper surface of the exposed portion 106, even if the ink overflows from the sheet 1 in the image recording operation to be explained later, it is possible to absorb such overflowing ink thereby avoiding ink deposition on the back surface of the sheet 1. The ink absorbent member 119 is rendered detachable from the media cartridge 100 and can be replaced by another ink absorbent member after ink absorption.

Also the ink absorbent member 119 is not limited to the above-mentioned material, and may be composed of any material capable of absorbing ink, such as a sponge-like absorbent member.

A cap 150 provided openably in a predetermined position of the exposed portion 106 is so positioned as to cap a suction aperture 150*a* connected to an unrepresented negative pressure recovery pump. In the present embodiment, the negative pressure recovery pump is made separate from the suction pump 52 connected with the suction joint 117, but the negative pressure recovery pump and the suction pump 52 may be composed of a common pump with a switching valve. Also the positions of such pumps are not limited to those shown in the present embodiment and in the accompanying drawings.

As explained in the foregoing, the shutter member 102 is closed so as to cover the exposed portion 106, as shown in FIG. 5, by an unrepresented closing mechanism when the media cartridge 100 is not mounted on the image recording apparatus. Thus, the cap 150 and the joints 116, 117 of the exposed portion 106 are protected from dust. Also the ink absorbent member 119 containing ink can be prevented from contact by the user.

Image Recording Operation

In the following there will be explained the image recording operation by the image recording apparatus and the media cartridge 100 explained in the foregoing, with reference to FIGS. 10A to 16. In the following it is assumed that the media cartridge 100 is already mounted on the image recording apparatus.

At first, in response to an image recording command, the control portion 18 shown in FIG. 4 executes, after an initializing operation, an operation of replenishing inks of an amount required for printing an image on a sheet, in the ink tank chambers 126 to 129 of the carrier 11.

In the ink replenishing operation, the carrier motor 9 is rotated in a predetermined direction to rotate the lead screw 3 thereby moving the carrier 11 along the lead screw 3, and stopping it at a predetermined position. In this state, the supply needles 133 (and the suction needle 134) of the carrier 11 are in positions opposed to the supply joints 116 (and the suction joint 117) of the exposed portion as shown in FIG. 10A.

After the carrier 11 is stopped at the predetermined position, the control portion 18 energizes the magnetic solenoid 51 to rotate the carrier 11 toward the sheet, about the lead screw 3, whereby the supply needles 133 are inserted into the supply joints 116 as shown in FIG. 10B. At this point, the feeding of the sheet is not started, so that the insertion of the supply needles 133 is not hindered.

Figure 11A:
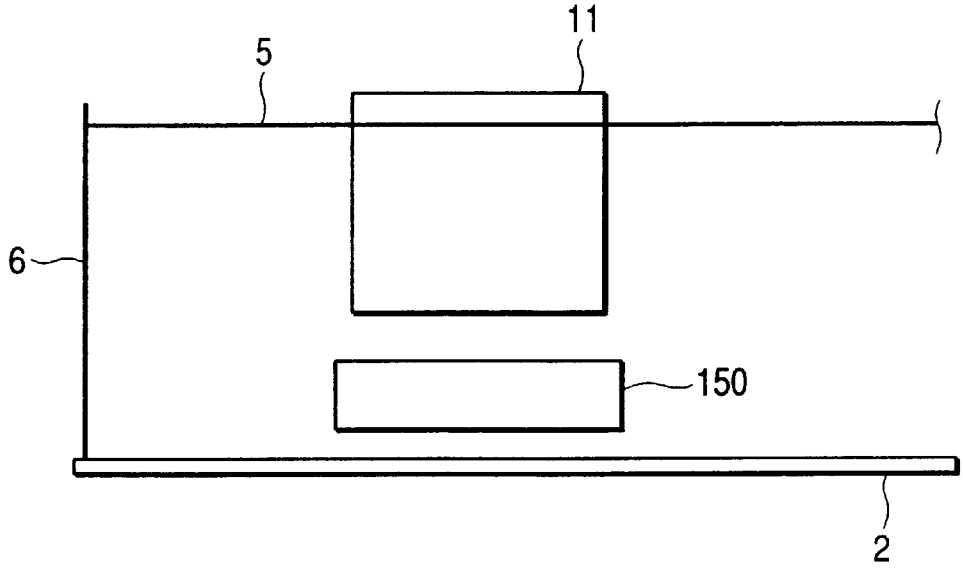
FIG. 11A is a schematic view showing the state of a guide wire for maintaining the posture of a carrier supporting the recording head.
Figure 11B:
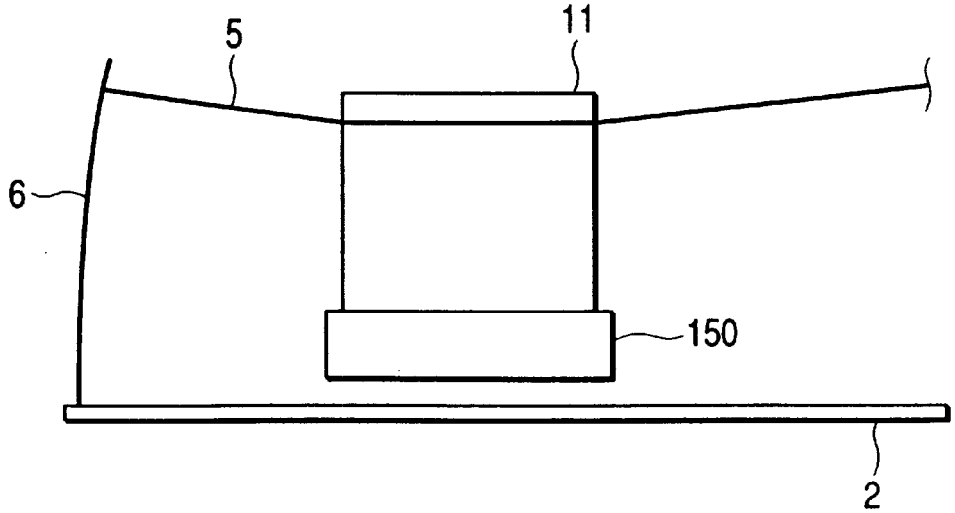
FIG. 11B is a schematic view showing the state of the guide wire for maintaining the posture of the carrier in an ink replenishing operation.

A guide wire 5, engaging with a side of the rotating end of the carrier 11, is tensioned as shown in FIG. 11A at the movement of the carrier 11, but becomes bent as shown in FIG. 11B because of the flexibility of the wire, as the carrier 11 rotates. Therefore the guide wire 5 does not hinder the movement of the carrier 11.

The tension plate 6 is also rendered bendable in order to allow such bending of the guide wire 5. The shape and thickness of the tension plate 6 have to be so selected that the guide wire is not normally bent by the weight of the carrier 11 in the printing operation. However, in the pit-in method in which the printing is executed by replenishing ink for each image recording as in the present embodiment, the required tension is small since the weight of the carrier 11 is extremely light. Therefore, even if the tension plate 6 is so selected as to bend following the deformation of the guide wire 5, the carrier 11 can be guided without any difficulty.

Thereafter, the suction pump 52 is activated to generate a negative pressure in the suction pipe 131. Thus the interior for example of the ink tank chamber 126 containing yellow ink also assumes a negative pressure, whereby the ink in the ink bag 109Y enters the ink tank chamber 126 through the supply joint 116Y and the supply needle 133Y.

When the liquid level is elevated thereafter and touches the full capacity valve 130, the ink supply is terminated since the full capacity valve 130 only passes gas and does not pass liquid. Other ink tank chambers 127 to 129 are similarly filled with inks in succession, and, after the lapse of a predetermined time, all the ink tank chambers 126 to 129 are fully filled whereupon the ink supply is terminated.

After the completion of the ink replenishment, there is executed a feeding operation for the sheet 1. As the present embodiment employs a method of separating the lowermost sheet from the stacked sheets, the limiting guide 107 for limiting the upper surface of the stacked sheets applies a downward pressure, as explained in the foregoing.

As the image recording apparatus is positioned horizontally at the image recording operation, separation and feeding of the sheet 1 can be achieved by the weight of the sheet 1 and such pressurization is unnecessary. Nevertheless, it is preferable to apply a certain biasing force, in consideration of the eventual fluctuation in the position of the image recording apparatus and in order to secure the reliability in operation.

Thus the feeding operation of the sheet 1 is initiated. The control portion 18 energizes the magnetic solenoid 19 and drives the feeding motor 15 at a predetermined timing to rotate the conveying rollers 13.

Figure 12A:
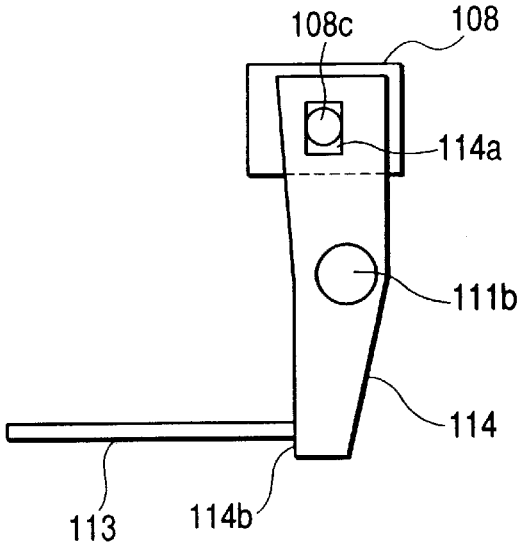
FIGS. 12A and 12B are schematic lateral views respectively showing a sheet feeding member and a state thereof in a sheet feeding operation.
Figure 12B:
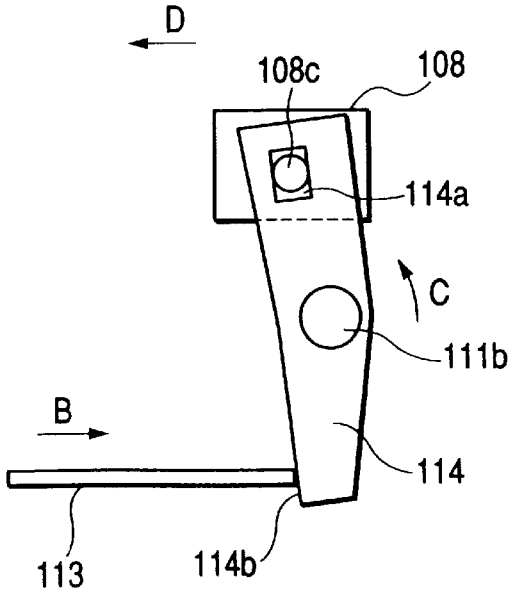

When the magnetic solenoid 19 is energized, the action shaft 113 which has been in contact with the action face 114*b* of the action lever 114 as shown in FIG. 12A is moved in a direction B as shown in FIG. 12B to push the action face 114*b*, whereby the action lever 114 rotates in the counterclockwise direction C about the shaft 111*b*.

As the action shaft 108*b* of the notch joint 108 engages with the square hole 114*a* of the action lever 114, the rotation of the action lever 114 causes the notch joint 108 to execute a parallel sliding motion in a direction D.

Figure 13A:
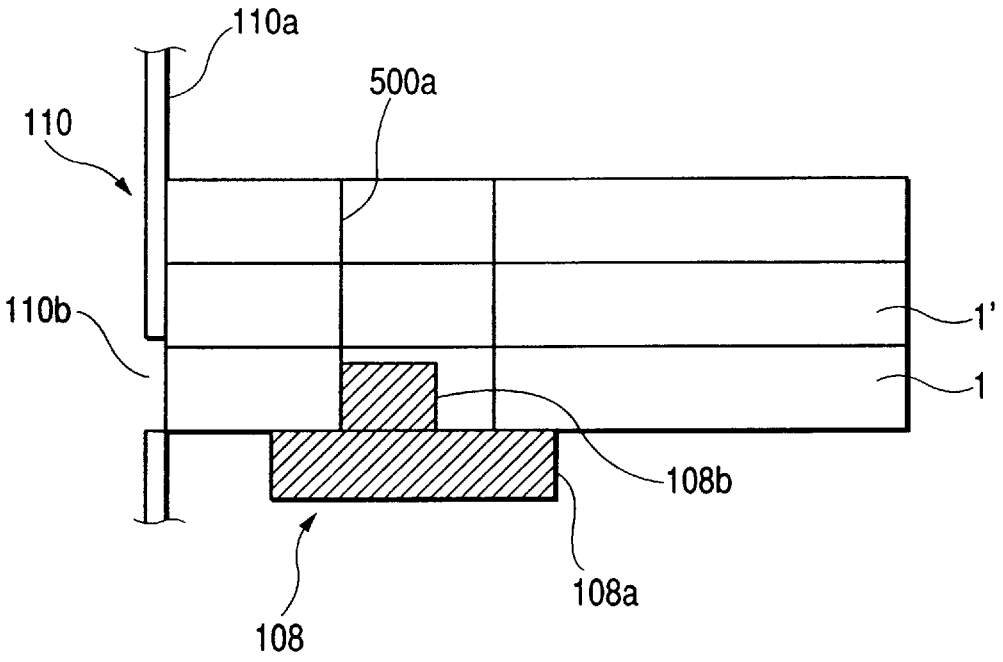
FIGS. 13A and 13B are lateral views respectively showing a state in which the sheet feeding member engages with a sheet and a state of sheet feeding by the sheet feeding member.
Figure 13B:
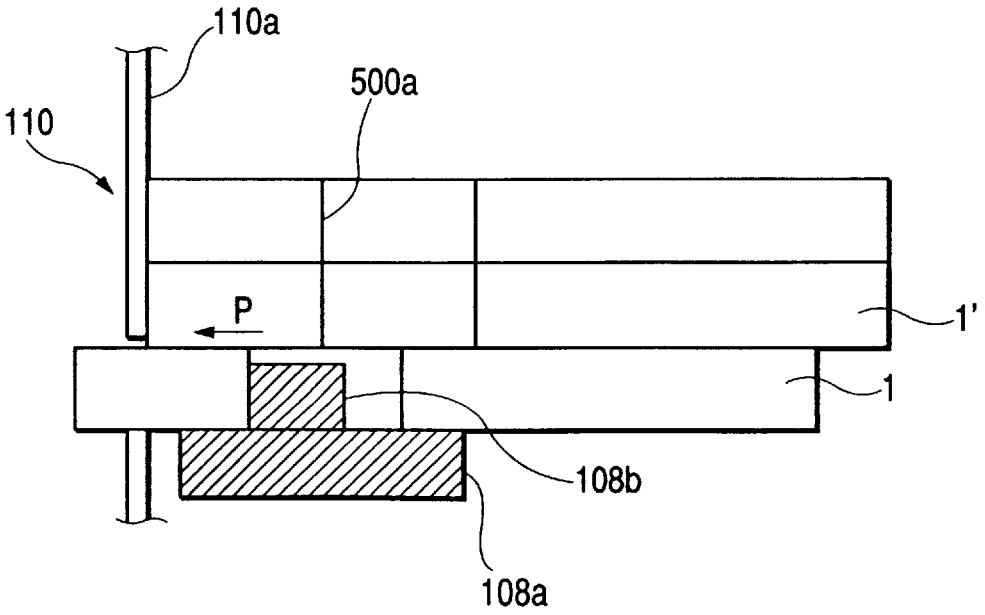

As the engaging pawl 108*b* of the notch joint 108 remains in the notch 500 of the sheet 1 in this state as shown in FIG. 13A, the sliding motion of the notch joint 108 causes the lowermost sheet 1 to be pushed forward, together with the notch joint 108, through the aperture 110*b* serving as the separating portion formed in the front wall 101A of the frame body 101 as shown in FIG. 13B.

Since the height of the engaging pawl 108*b* is selected somewhat smaller than the thickness of the sheet 1 as explained in the foregoing, the conveying force is not generated in the immediately upper sheet 1'. However a frictional force is generated by the friction between the sheets, so that the second and succeeding upper sheets receive a conveying force, though small, in the sheet feeding direction.

Consequently the aperture 110*b* is desirably so formed that the height thereof is larger than the thickness of the sheet 1 but smaller than the thickness of two sheets.

In this manner, even in case the second and upper sheets receive the conveying force in the sheet feeding direction, the sheets other than the desired one can impinge on the impinging portion 110*a* present above the aperture 110*b* and can be separated from the sheet to be fed.

In case the aperture 110*b* cannot be formed with such a height as to form the separating portion, the separating portion may be formed by a spring (not shown), provided on the internal surface of the front wall 101A, for providing the sheet 1 with a load not weaker than the frictional force.

On the other hand, the single sheet 1 thus separated and fed forward is supported between the conveying rollers 13 and the pinch rollers 118 which are in contact with the conveying rollers 13 by mounting of the media cartridge 100 on the image recording apparatus, and is conveyed by the conveying rollers 13 to a position above the ink absorbent member 119. As explained in the foregoing, the conveying rollers 13 are linked by the belt 16, thereby always achieving constant sheet advancing accuracy around the image recording unit.

The carrier motor 9 is activated when the sheet 1 is fed to the position above the exposed portion 106, whereby the carrier 11 executes reciprocating motion in the predetermined printing area, and the recording head 12 records an image on the surface of the sheet when the leading end of the sheet 1 reaches a position vertically below the recording head 12.

Figure 14A:
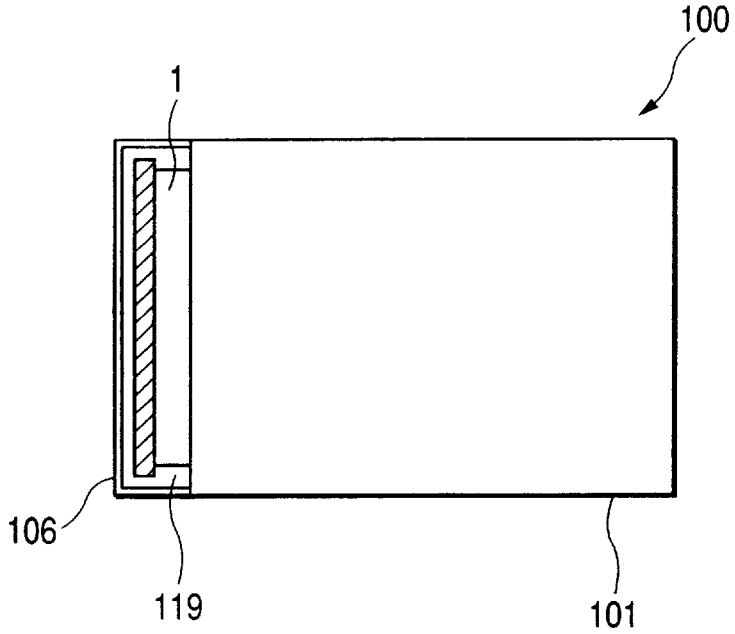
FIGS. 14A and 14B are schematic plan views showing the positional relationship between the ink absorbent member and the sheet, respectively at the leading end and at the trailing end of the sheet.

The present embodiment adopts a recording method capable of recording the image on the entire surface of the sheet. The image to be recorded without forming a margin is enlarged by image processing into a size somewhat larger (approximately 2 to 3%) than the sheet 1. Therefore, when the printing of such enlarged image is started, the printing operation is initiated from a position which is slightly in front of the leading end of the sheet, so that the ink for forming the image portion overflowing from the sheet 1, namely a hatched portion in FIG. 14A, is discharged to the underlying ink absorbent member 119.

However the image overflowing from the sheet 1 is not be deposited on the rear surface of the sheet 1, because of the ink absorbing function of the ink absorbent member 119. Also as shown in FIG. 14A, the image is printed slightly larger than the sheet 1 also in the transversal direction, namely the main scanning direction of the recording head 12, and the ink overflowing from the sheet 1 is also absorbed by the ink absorbent member 119.

Figure 14B:
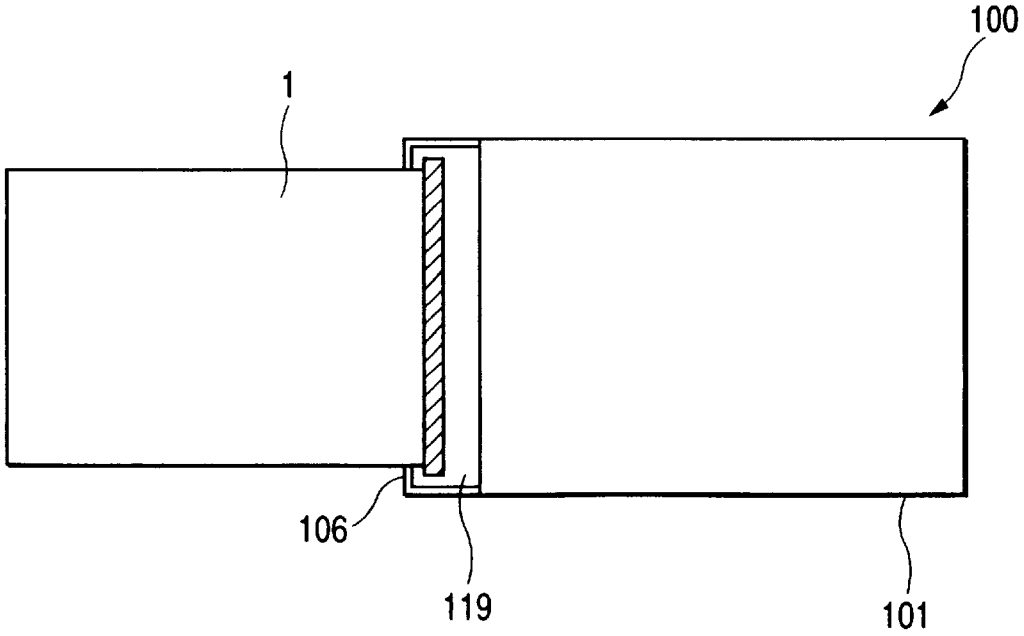

Also when the continued image recording operation reaches the trailing end of the sheet, the ink for forming a hatched portion shown in FIG. 14B is discharged, as in the case of the leading end, onto the ink absorbent member 119. Also in this case, the recording operation is executed with the overflowing portion being absorbed by the ink absorbent member 119, whereby the image recording onto the sheet 1 is terminated. Thereafter the sheet bearing the formed image is discharged from the main body of the apparatus to the exterior.

The printing on the entire sheet 1 without any marginal portion can thus be attained by enlarging the image to be printed to be slightly larger than the sheet 1. Since the enlarging process of the image is executed uniformly over the entire area, the printing on the entire sheet can be attained without distortion by processing the end portions. It is also possible to enlarge the image gradually toward the peripheral areas.

Also because of the presence of the ink absorbent member 119 for ink absorption in the exposed portion 106, the preliminary ink discharge for avoiding drying of the nozzles not used in the printing operation can be executed on the exposed portion 106 which is somewhat distant from the end portion of the sheet 1. Besides such preliminary ink discharge can be executed on both ends, so that the recording operation can be realized with a reduced loss in the printing time.

Figure 16:
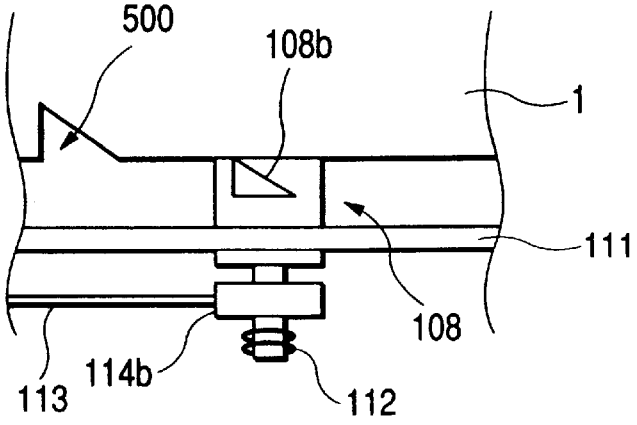
FIG. 16 is a schematic lateral view showing the state of the sheet feeding member in a state in which the image is recorded at a central portion of the sheet.

FIG. 15 shows a state of printing in the central portion of the sheet 1, in which the engaging pawl 108*b* of the notch joint 108 is disengaged from the notch 500 and is in pressure contact with the sheet 1 by the compression torsion spring 112 as shown in FIG. 16. Such pressurized contact of the engaging pawl 108*b* with the sheet 1 allows to avoid skewed feeding of the sheet 1 in the frame body 101.

In the foregoing description, the feeding side 500*a* of the notch 500 is formed perpendicularly to the feeding direction in order that the feeding power from the sheet feeding member 108 can be securely applied to the notch 500, but the present invention is not limited to such configuration, and the sufficient feeding power can be transmitted even in case the notch 500 is formed with two, three or more non-perpendicular sides.

Figure 17A:
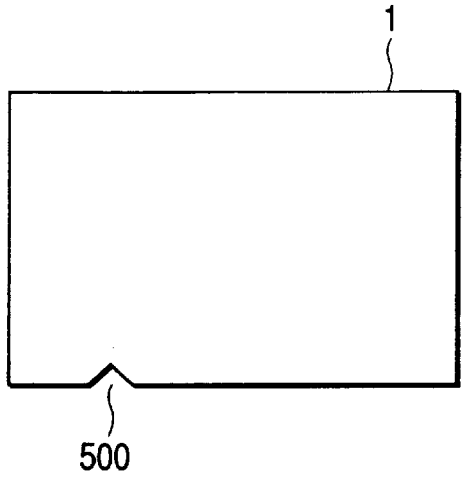
FIGS. 17A, 17B and 17C are views showing a notch formed in the sheet, respectively in substantially triangular, rectangular and semicircular shapes.
Figure 17B:
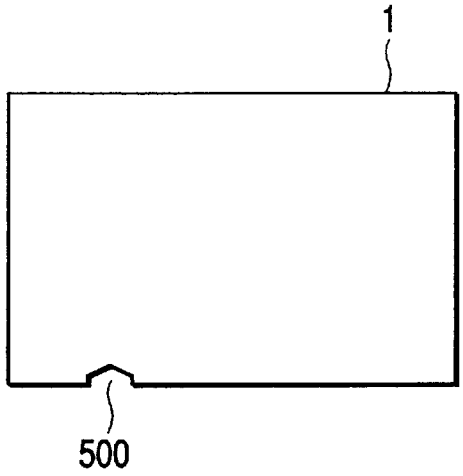
Figure 17C:
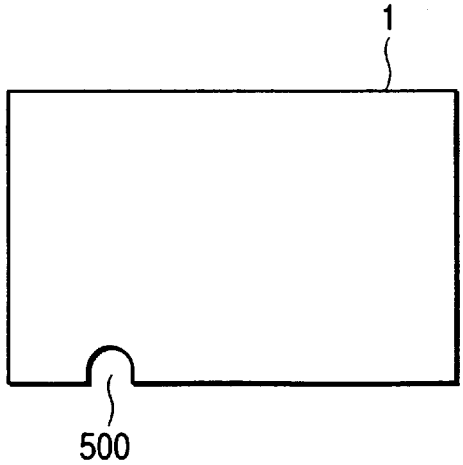

FIGS. 17A to 17C show other shapes of the notch formed on the sheet 1. FIG. 17A shows a chevron-shaped notch 500 formed by two angled sides, while FIG. 17B shows a polygon-shaped notch 500 with four sides, and FIG. 17C shows a semicircular (arc-shaped) notch 500. The notch shape shown in FIG. 17A provides an advantage of milder touch to the hand in sheet manipulation, as the ends of the notch are formed with blunt angles.

It is also possible to form a hole in the sheet 1 if the feeding power can be securely transmitted to the sheet 1. Such method is suitable for a soft sheet with relatively low rigidity.

Figure 18A:
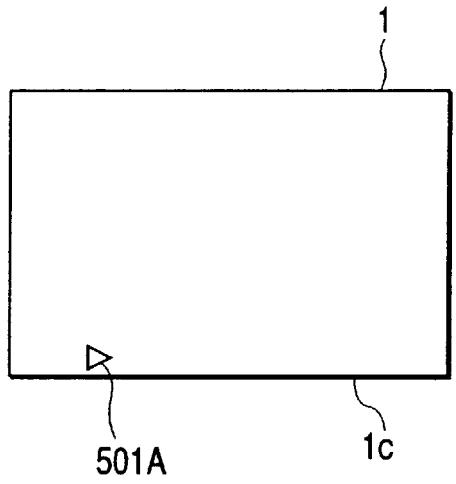
FIGS. 18A, 18B and 18C are views showing a hole formed in the sheet, respectively in a substantially triangular shape in an end portion of the sheet, in a substantially rectangular shape in an end portion of the sheet, and at the approximate center of the sheet in the transversal direction thereof.
Figure 18B:
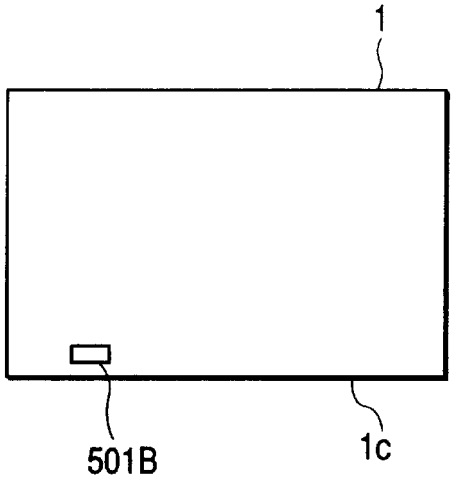
Figure 18C:
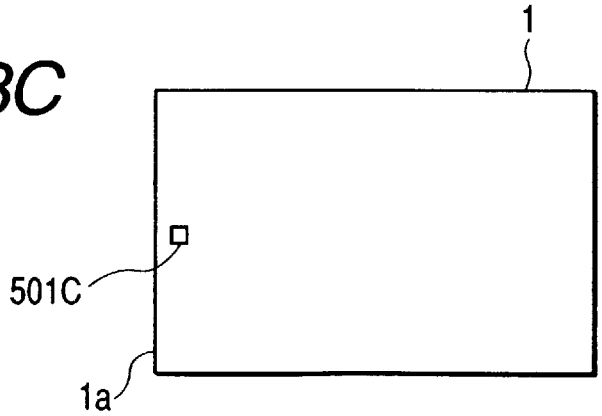

FIGS. 18A to 18C show a sheet 1 having a hole serving as an engaging portion. FIG. 18A shows a sheet 1 having a substantially triangular hole 501A in the vicinity of the left side edge 1*c*, while FIG. 18B shows a sheet 1 having a substantially rectangular hole 501B in the vicinity of the left side edge 1*c*. The shape of the hole 501 is not limited to those illustrated but may also be circular or polygonal shape.

FIG. 18C shows a sheet 1 having a hole 501C at the center in the vicinity of the leading edge 1*a*. Formation of the hole 501C in such position allows to avoid stress toward the side and is particularly effective for a sheet of low rigidity.

In case the sheet 1 is provided with such hole 501, the aforementioned notch joint 108 has to have an engaging pawl matching the shape of the hole 501 and has to be positioned not on the lateral plate 111 but under the unrepresented sheet supporting plate. The mechanism for moving such notch joint 108 can be similar to that already explained in the foregoing.

Figure 19:
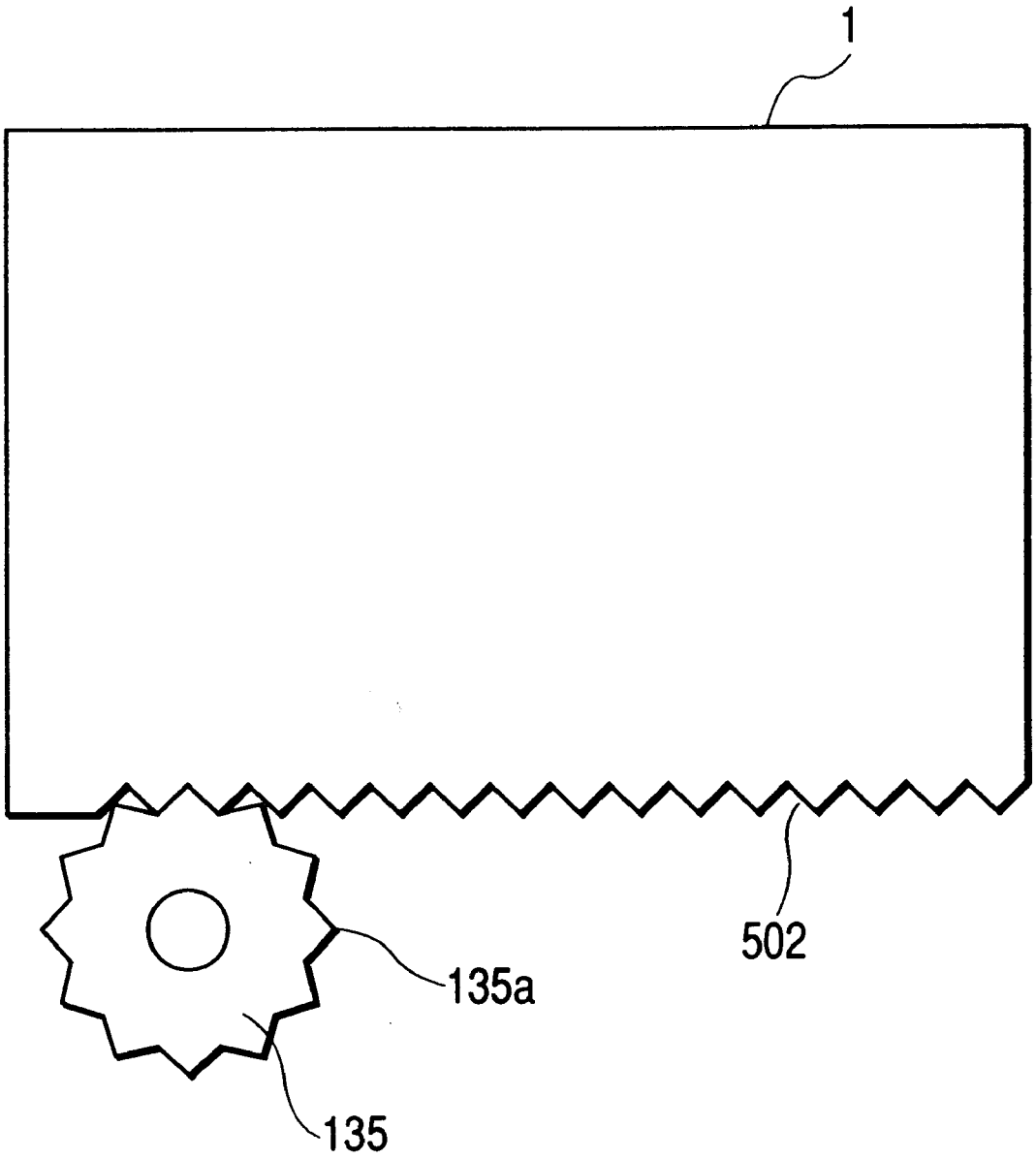
FIG. 19 is a view showing another shape of the sheet feeding member for feeding the sheet.

FIG. 19 shows a sheet 1 having rack-shaped notches 502 in continuous manner over the entire lateral face (left side edge 1*c*). A feeding gear 135 serving as a sheet feeding member is provided on the periphery thereof with teeth 135*a* serving as engaging pawls for engaging with the notches 502. The sheet 1 can be fed by rotating the feeding gear 135 by an unrepresented feeding motor which constitutes the pickup portion together with the feeding gear 135.

Figure 20A:
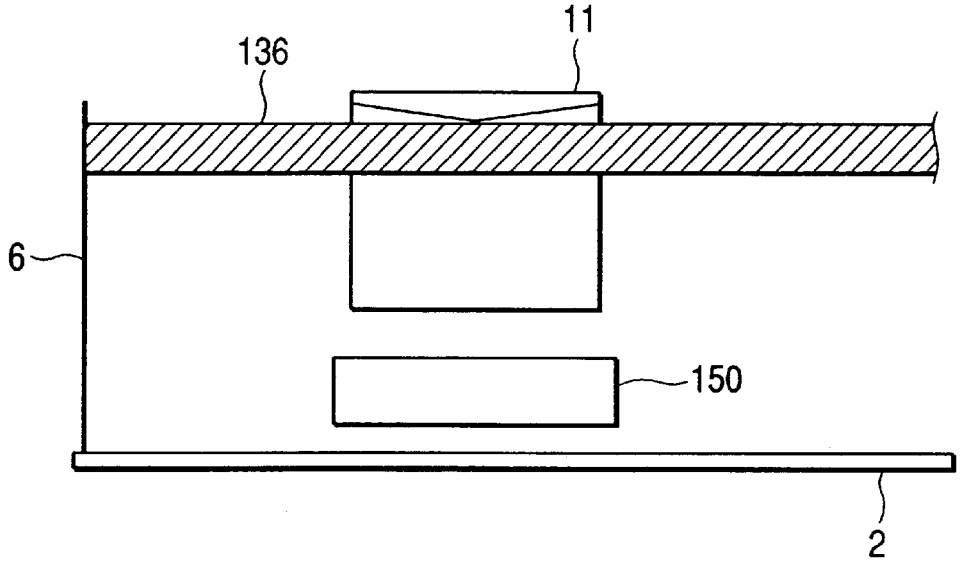
FIGS. 20A and 20B are schematic cross-sectional views respectively showing a guide ribbon for maintaining the posture of the carrier supporting the recording head, and the state of the guide ribbon in an ink replenishing operation.
Figure 20B:
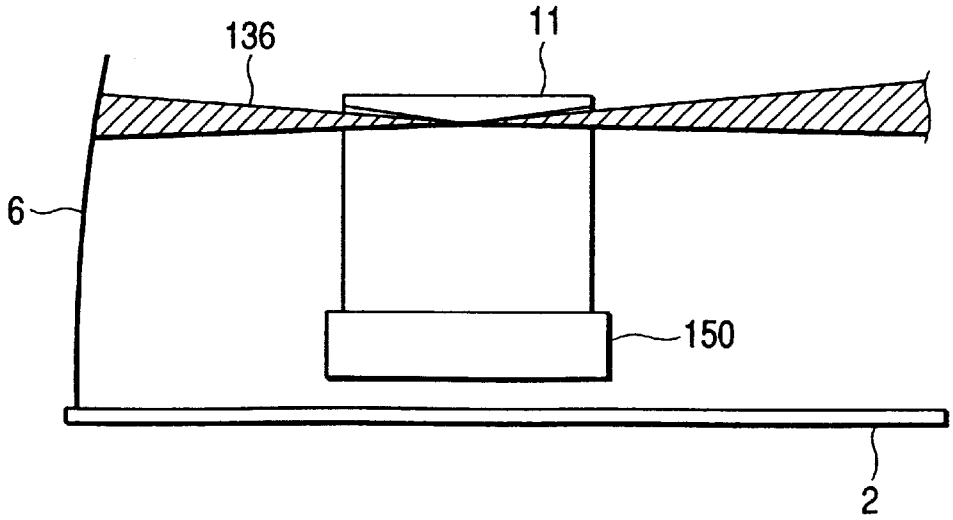

In the foregoing description, the guide wire 5 consisting of twisted piano wires is used for maintaining the position of the carrier 11, but the present invention is not limited to such configuration and there may be employed a guide ribbon 136, composed of a ribbon-shaped flexible material, as shown in FIGS. 20A and 20B.

Such guide ribbon 136 is supported between the tension plate 6 and the right lateral plate 2*a* of the base 2 as in the case of the guide wire 5, and, during the printing operation, remains in a vertical position and supports the carrier 11 on an edge as shown in FIG. 20A, thus functioning as the guide without bending under a slight tension. On the other hand, when the carrier 11 is rotated, the tension plate 6 is deformed as shown in FIG. 20B to release the tension of the guide ribbon 136. The guide ribbon 136 can be easily bent in a direction across its thickness, so that the rotating operation of the carrier 11 can be executed smoothly.

Figure 21:
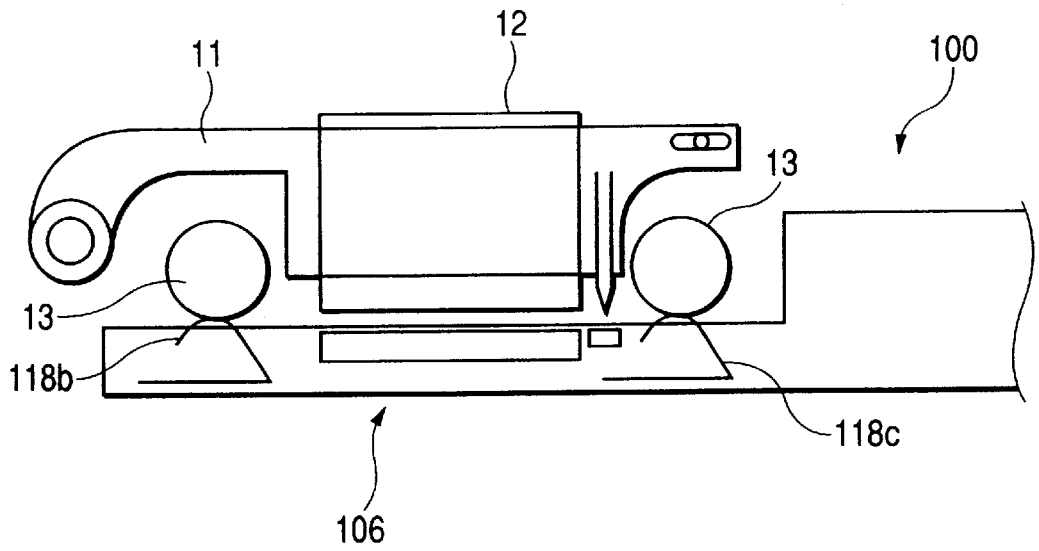
FIGS. 21 and 22 are views showing other configurations of the conveying means for conveying the sheet.

Also in the foregoing, there has been described a configuration in which the pinch rollers 118 are contacted by the pinch roller springs 118*b* with the conveying rollers 13 with a contact pressure matching the sheet in order to convey the sheet 1 without slipping or jamming, but the present invention is not limited to such configuration and it is also possible, as shown in FIG. 21, to provide the exposed portion 106 with plate springs 118*c* instead of the pinch rollers 118 and to contact such plate springs 118*c* with the conveying rollers 13.

The sheet 1 can be conveyed appropriately without slippage or jamming by so selecting the pressure of such plate springs 118*c* as to generate a pressure matching the thickness or material of the sheet 1 in cooperation with the conveying rollers 13. The use of such plate springs 118*c* allows to provide the media cartridge and the image recording apparatus simplified in structure and reduced in cost.

In such configuration with the plate springs 118*c* contacting the conveying rollers 13, in order to reduce the load applied by the contacting plate springs 118*c* onto the conveying rollers 13, a coating of low frictional coefficient is applied on the surface of the conveying rollers 13 coming into contact with the plate springs 118*c*.

Figure 22:
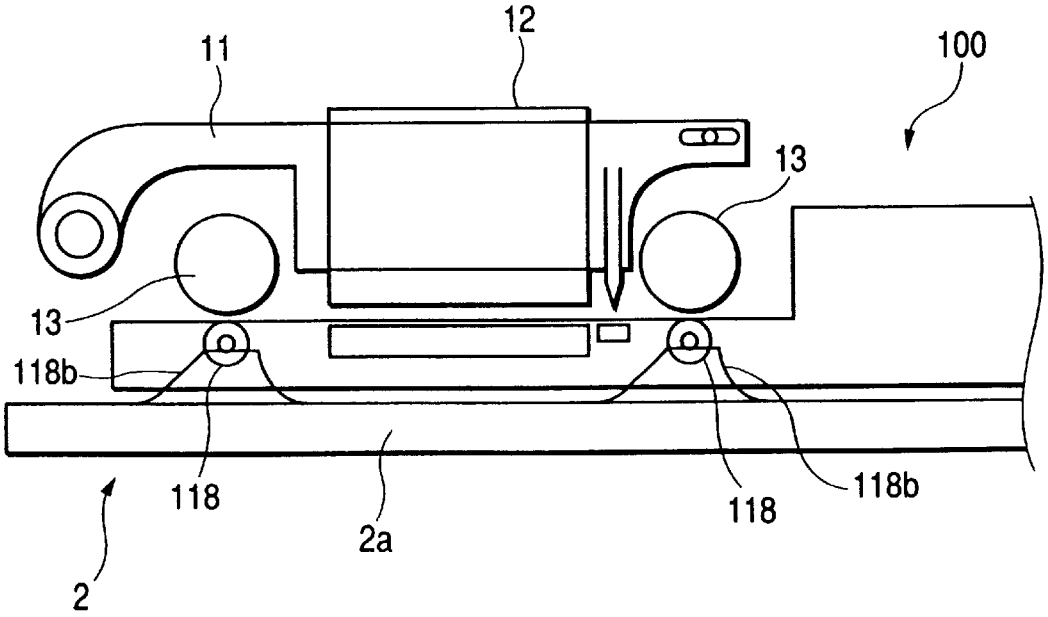

Also in the foregoing, there has been explained a configuration in which the pinch roller springs 118*b* for contacting the pinch rollers 118 with the conveying rollers 13 are provided in the exposed portion 106, but the present invention is not limited to such configuration and the pinch roller springs 118*b* may also be provided on the base 2 (base portion 2*a*) of the image recording unit as shown in FIG. 22. In case the pinch roller springs 118*b* are provided on the base 2, the exposed portion 106 is provided, at the bottom face thereof, with apertures for contacting the pinch roller springs 118*b* with the pinch rollers 118.

As explained in the foregoing on the image recording apparatus and the media cartridge 100, the frame body 101 incorporating the sheet 1, the ink, the feeding member 108 for feeding the sheet 1 and the separating portion 110 allows to compactize the image recording apparatus, thereby enabling to incorporate the image recording apparatus in the interior of another equipment.

Also the frame body 101, incorporating the sheet 1 and the ink which are consumables, facilitates to use the ink matching the kind of the sheet desired by the user. Also the ink can be contained in an amount matching the amount of the sheets, the ink can be almost used up when all the sheets contained in the media cartridge 100 are recorded. It is therefore not necessary to store the unnecessary ink in the cartridge 100, thereby providing apparatus of high cost advantage.

Furthermore, as the sheets 1 and the ink in the media cartridge 100 can be used up almost at the same time, the media cartridge 100 can be re-used by replenishing the sheets and the ink.

Also, since the ink absorbent member 119 is provided in the media cartridge 100, it can be easily replaced by detaching the ink-containing member and attaching a new member at the re-use of the media cartridge 100.

Also as the ink absorbent member 119 is provided in the media cartridge 100, the absorbent member can be easily replaced by detaching the used one and attaching the new one at the re-use of the cartridge 100, with improved work efficiency.

In addition there can be provided the following significant advantage. In the conventional image recording apparatus, the ink absorbent member or the used ink tank is not designed for replacement and has therefore to absorb or store a large amount of ink. Therefore such component for handling the used ink becomes inevitably bulky, eventually resulting in an increase in the dimension and cost of the image recording apparatus.

On the other hand, as the media cartridge 100 contains the ink absorbent member 119, it can be replaced at the replenishment of the sheet 1 or the ink, so that the absorbent member 119 is only required to absorb the surplus used ink resulting from the ink contained in the same cartridge.

Stated differently, since the absolute amount of ink to be discharged is known, it is possible to estimate, to a certain extent, the amount of the used ink to be absorbed by the ink absorbent member based on such absolute ink amount. Consequently the ink absorbent member 119 can achieve its object as long as it can securely absorb thus estimated amount and is replaced at the replenishment of the sheet and the ink. Consequently the ink absorbent member 119 can be made smaller in size. Also, since it is periodically replaceable, it can be composed of an inexpensive material with moderate absorbing ability, thereby contributing significantly to the cost reduction of the apparatus.

Furthermore, as the sheets 1 and the pickup portion 105 for sheet feeding are provided in the same frame body 101, the positional precision between the sheet 1 and the pickup portion 105 can be maintained at a high level even when the media cartridge 100 is mounted on or detached from the image recording apparatus. In the conventional apparatus in which the sheet feeding means is provided in the image recording apparatus, the positional precision may be deteriorated for example by an impact at the attaching or detaching of the media cartridge 100. Also it may be expected to mount media cartridges containing different sheets or different inks on a same image recording apparatus or to mount a media cartridge on different image recording apparatus belonging to various information equipment. In such case, the sheet feeding may be disturbed by a deterioration in the positional precision between the sheet 1 and the pickup portion 105, resulting from the abrasion of the components in the prolonged use or from the error in assembling.

However, the media cartridge 100 integrally containing the sheet 1 and the pickup portion 105 allows to prevent the above-mentioned drawbacks resulting from the deterioration of the positional precision, thereby achieving image recording of high reliability.

Also for mobile printing, it is necessary to also consider the carrying of the media cartridge 100, and the safety in such carrying operation is improved by providing the exposed portion 106 with the slidable shutter member 102 thereby preventing the eventual contact of the user with the ink absorbent member.

Also in case the media cartridge contains sheets of plural materials, the presence of the pickup portion in the media cartridge allows to set the pickup portion 105 according to the material or property of the sheet. For example it is possible to adjust the aperture or the feeding power of the separating portion 110 according to the sheet thickness, thereby achieving satisfactory feeding operation. It is thus possible to improve the applicability and reliability of the image recording apparatus.

In the following there will be explained a variation of the foregoing embodiments with reference to FIGS. 23 to 27, in which components equivalent in configuration or function to those in the foregoing description will be represented by corresponding numbers and will not be explained further.

The present variation is featured in the configuration of the media cartridge. The sheet containing portion 103 and the ink containing portion 104 are similar to those in the first embodiment and will not, therefore, be explained.

<Pickup Portion>

Figure 23:
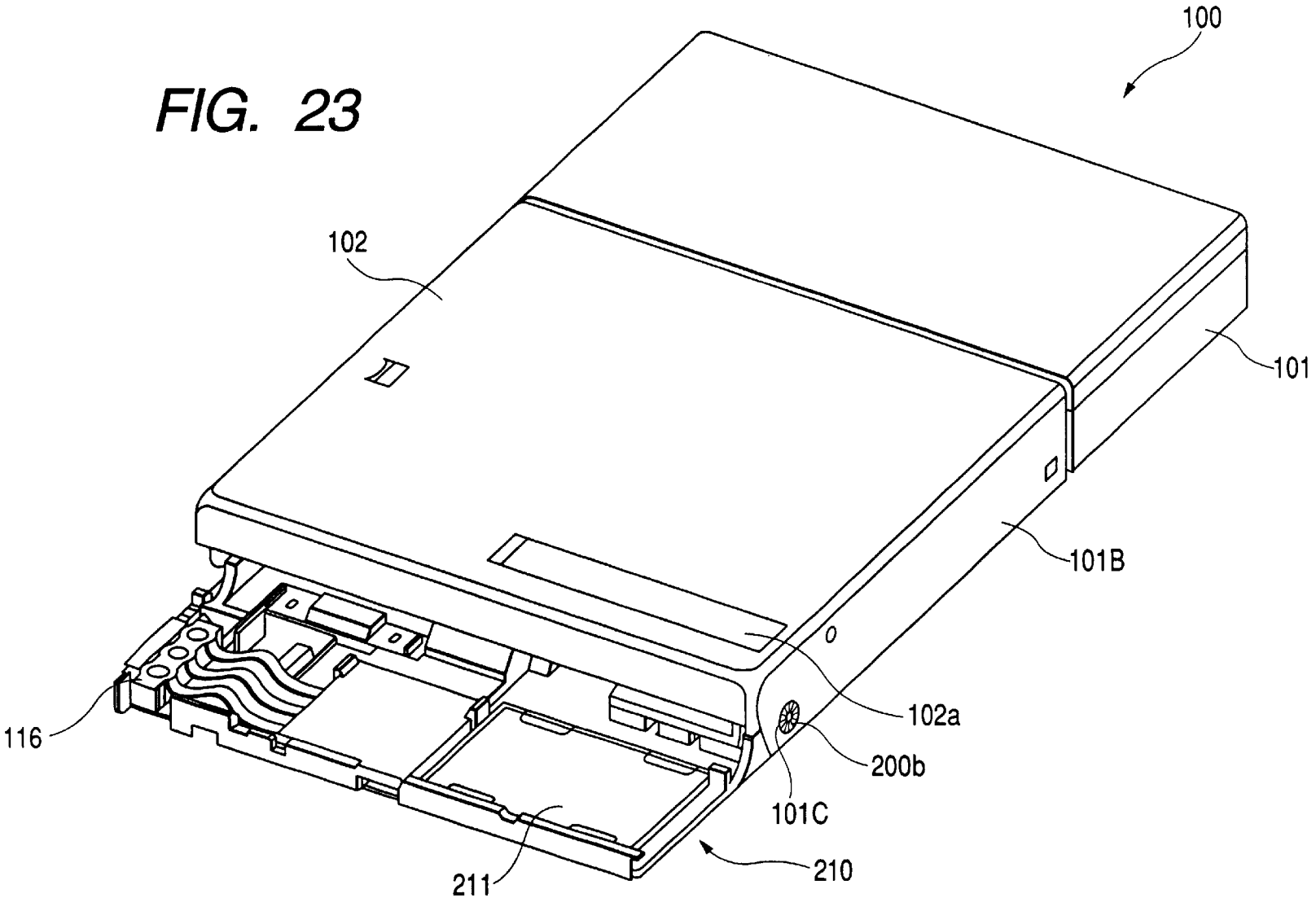
FIG. 23 is a schematic perspective view showing another configuration of the media cartridge.
Figure 24:
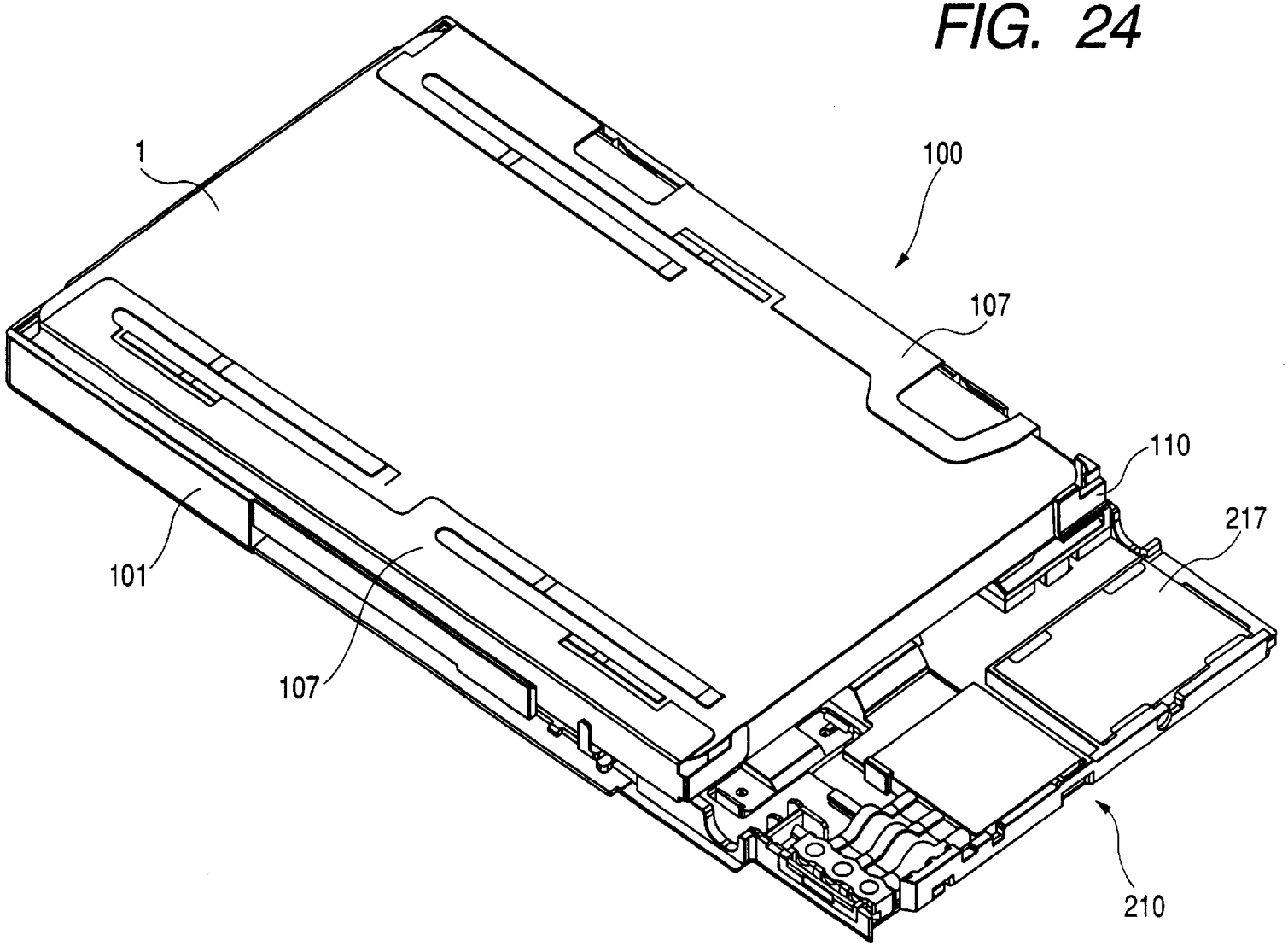
FIG. 24 is a schematic perspective view showing the interior of the media cartridge.
Figure 25:
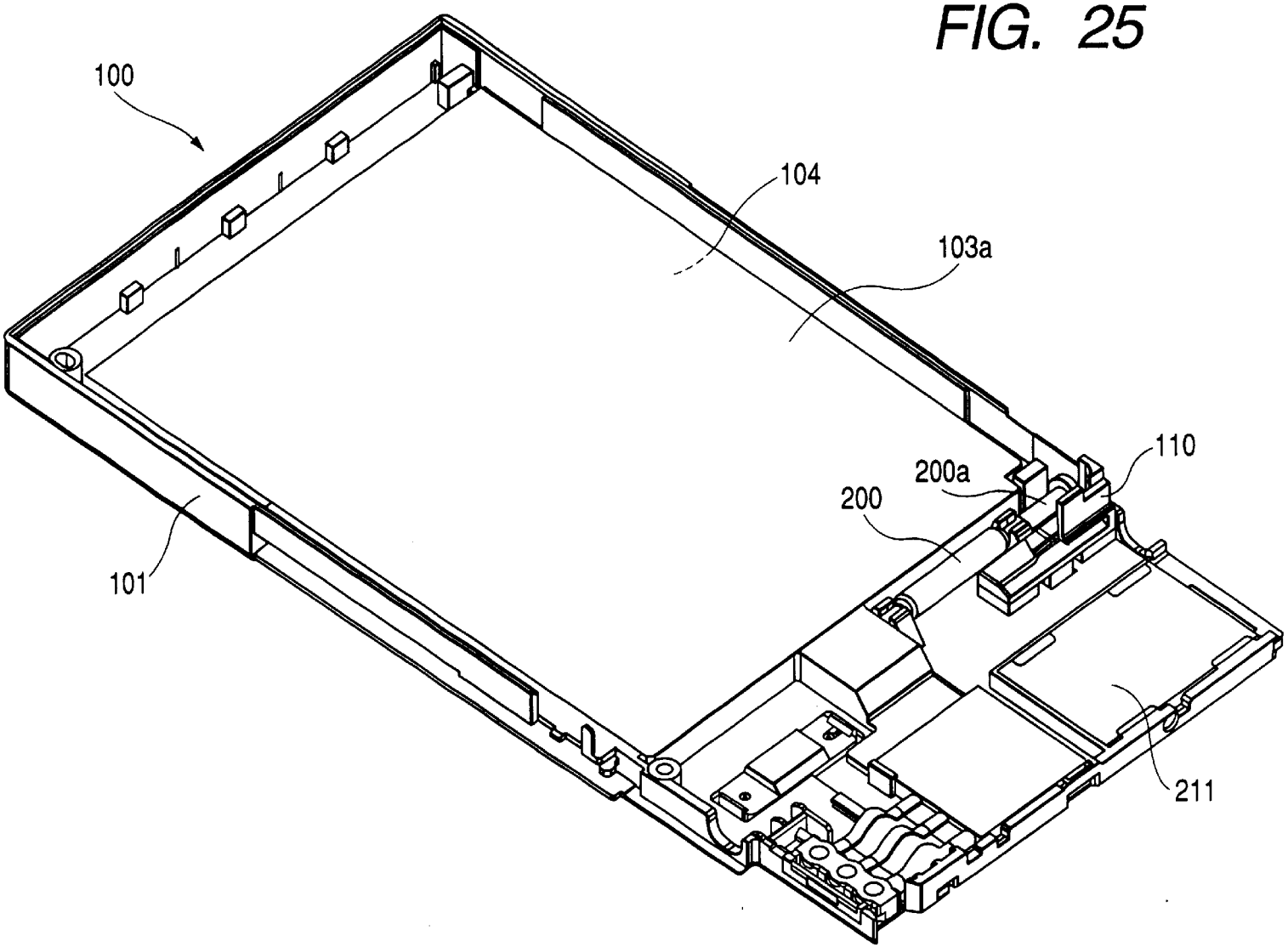
FIG. 25 is a schematic perspective view showing the interior of the media cartridge in a state without the sheets.
Figure 26:
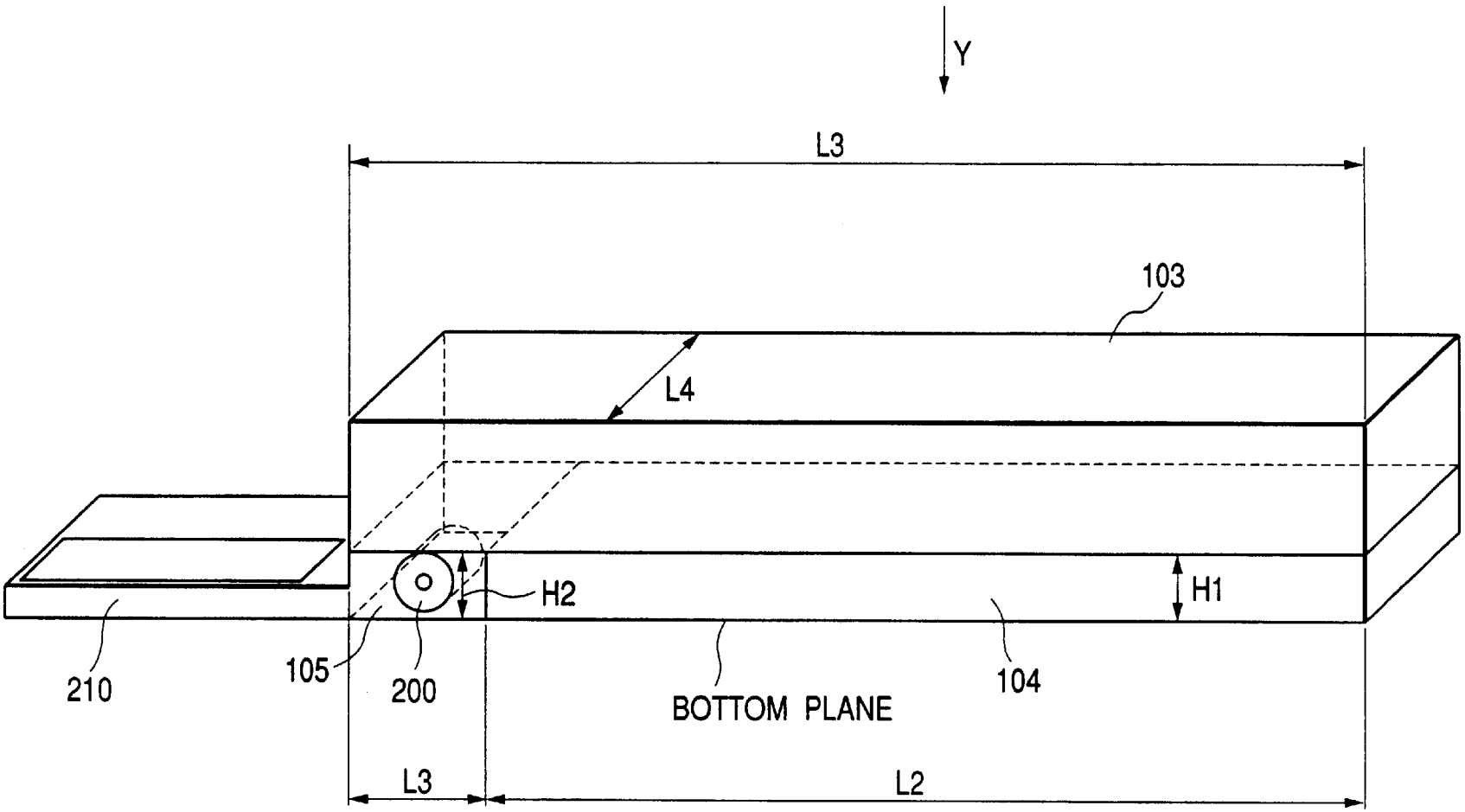
FIG. 26 is a schematic lateral view showing the positional relationship of various members in the media cartridge.

FIG. 23 is a schematic perspective view of a media cartridge 100 in a state where an exposed portion 210 is exposed by the sliding motion of the shutter member 102; FIG. 24 is a perspective view of the media cartridge 100 in a state without the shutter member 102 and the upper cover of the frame body 101; FIG. 25 is a perspective view in a state shown in FIG. 24 and without the sheet 1; FIG. 26 is a schematic lateral view of the media cartridge 100; and FIG. 27 is a perspective view showing drive means and a pressurizing member to be explained later and provided in the main body of the image recording apparatus.

As shown in FIG. 25, the pickup portion 105 for advancing the sheets 1, contained in the sheet containing portion 103, one by one from the lowermost sheet 1 is provided with a sheet feeding roller 200 serving as the sheet feeding member 108 for contacting the lowermost sheet 1 and advancing the same toward the exposed portion 210, and a separating portion 110 for separating the lowermost sheet 1 among the sheets advanced by the sheet feeding roller 200.

The sheet feeding roller 200 is provided under the sheet containing portion 103 and in front of the ink containing portion 104, namely at the downstream side of the ink containing portion 104 in the sheet feeding direction. In the present embodiment, the sheet feeding roller 200 is composed of a substantially cylindrical roller, but it may also be composed of a roller with a substantially semicircular cross section. The sheet feeding roller 200 is detachably supported by the media cartridge.

Figure 27:
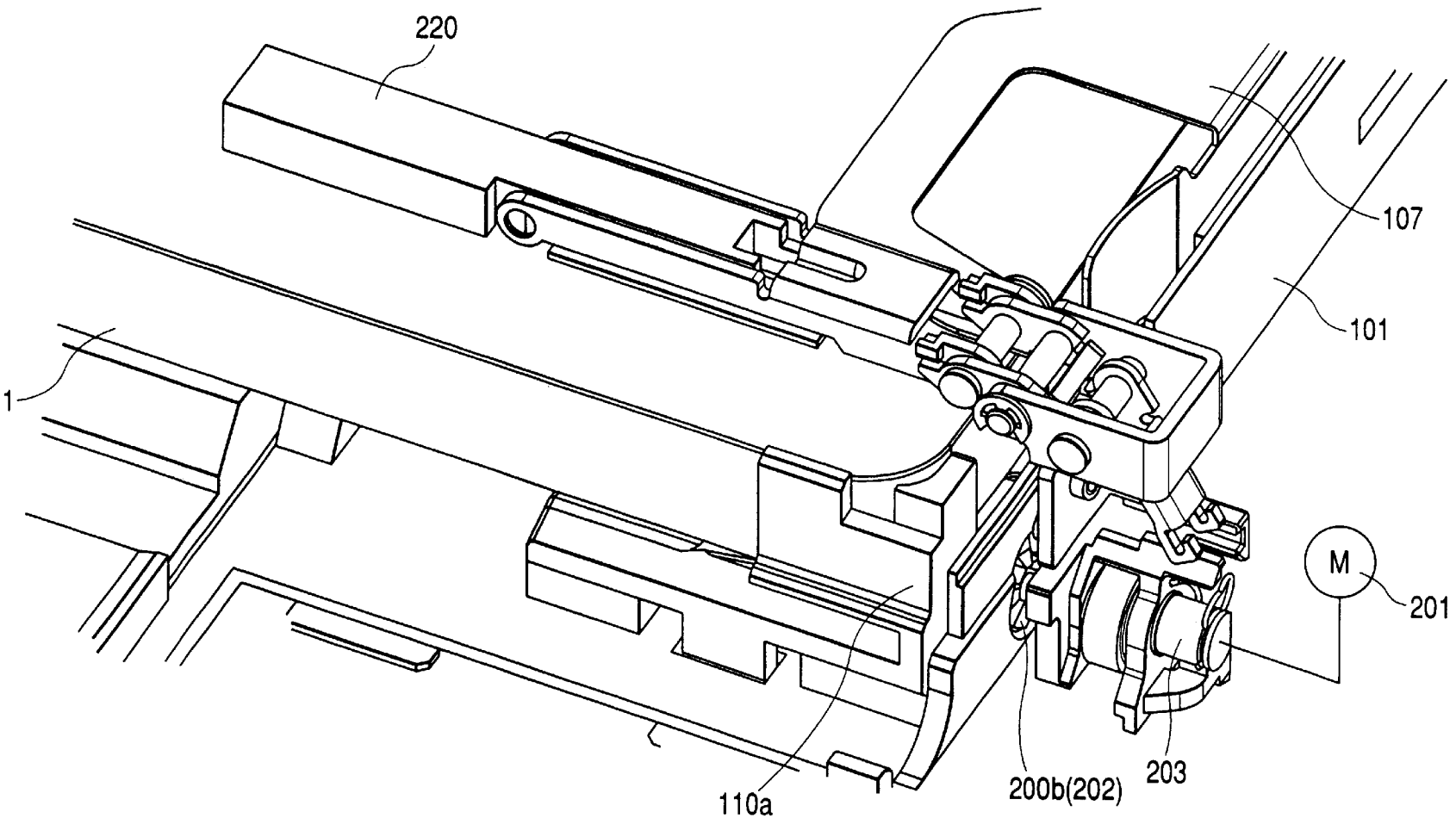
FIG. 27 is a schematic perspective view showing drive means and a pressurizing member relating to sheet feeding.

As shown in FIGS. 23 and 27, the sheet feeding roller 200 is rotated by a sheet feeding motor 201 provided in the main body of the image recording apparatus. The driving force for the sheet feeding roller 200 is transmitted by the engagement of a coupling **200*b*, formed on a sheet feeding roller shaft 200*a* fitted in a hole 101C on a lateral face 101B of the frame body 101, with a coupling 202 provided on a drive shaft 203 driven by the sheet feeding motor 201**.

As shown in FIG. 26, the length L1 of the sheet containing portion 103 in the sheet feeding direction is approximately same as the sum of the length L2 of the ink containing portion 104 and that L3 of the sheet feeding roller 200 in the sheet feeding direction.

Also the length L4 in the transversal direction of the sheet 1 is selected same as the length of the ink containing portion 104 in the transversal direction, and the length of the sheet feeding roller 200 in the transversal direction (namely the length of the shaft **200*a* supporting the roller 200 in the thrust direction) is made shorter than the sheet width L4. Thus, when the sheet containing portion 103 is observed from above (in a direction Y), the ink containing portion 104 and the pickup portion 105 are substantially included in the projected area of the sheet containing portion 103**.

Thus, the size of the frame body 101 is naturally at least equal to the size of the contained sheet, but the sheet feeding roller 200 and the ink containing portion 104 can be accommodated within such sheet size, so that the media cartridge 100 can be compactized.

Also when the frame body 101 is observed from the side, as shown in FIG. 26, the height H1 of the ink containing portion 104 is selected approximately equal to the height H2 of the sheet feeding roller 200, so that the components are efficiently housed in the frame body 101 without wasted space under the sheet containing portion 103. It is therefore possible to reduce the size and simplify the structure of the frame body 101.

As in the foregoing first embodiment, the separating portion 110 is of a slit separation type provided with an aperture (slit) **110*b* for passing the lowermost sheet 1 and an impingement portion 110*a* for inhibiting the movement of other sheets. The impingement portion 110*a* is composed of a part of the sheet containing portion 103, and limits the movement of the sheets 1 in the longitudinal direction by being impinged by the leading end of the sheets 1. In the present embodiment, the aperture 110*b* and the impingement portion 110*a* are provided in a part of the width of the sheet 1, namely at the side of the sheet feeding roller 200**, but they may be formed over the entire width of the sheet.

<Exposed Portion>

The exposed portion in the foregoing embodiment also has a function of platen for supporting the sheet 1 in the image recording, but, in the present embodiment, the platen portion (not shown) is provided in the main body of the image recording apparatus. Also the pinch rollers (not shown) are provided in the main body of the image recording apparatus.

An ink absorbent member 211, formed in the same manner and with the same material as in the foregoing embodiment, is provided in a part of the right side of the exposed portion 210 in FIG. 23. The ink absorbent member 211 executes absorption of the ink discharged for example in the preliminary discharge and absorption of the ink overflowing in the printing on the entire area of the sheet as in the foregoing embodiment, and provides the aforementioned advantages obtained by positioning the ink absorbent member 211 in the exposed portion 210 of the media cartridge 100.

Sheet Feeding Operation

In the following, the feeding operation for the sheet 1 will be briefly explained. When the media cartridge 100 is mounted on the main body of the image recording apparatus, the main body engages with the shutter member 102 to cause the sliding motion thereof, thus exposing the exposed portion 210, which thus awaits the start of the recording operation, in a position vertically below the recording head 12 (state shown in FIG. 23, the recording apparatus being not shown). The ink supplying operation will not be explained as it is same as in the foregoing embodiment.

As shown in FIG. 27, a pressurizing or pressing member 220 is provided in the main body of the image recording apparatus and applies a pressure required for sheet feeding toward the sheet feeding roller 200. The pressurizing member 220 is provided vertically above the sheet feeding roller 200, with a length approximately equal to the thrust length thereof. Until the sheet feeding is initiated, the pressurizing member 220 waits in a state separated from the uppermost sheet.

Also as shown in FIG. 23, the shutter member 102 is provided with an aperture 102*a* for enabling pressurization of the sheet 1 by the pressurizing member 220, and the aperture 102*a* is so provided as to be positioned vertically below the pressurizing member 220 when the shutter member 102 slides so as to expose the exposed portion 106.

As explained in the foregoing, the sheet feeding roller 200 is driven by the sheet feeding motor 201 provided in the main body of the image recording apparatus. The coupling 202 of the sheet feeding motor 200 is provided in a position opposed to the coupling 200*b* of the aforementioned sheet feeding roller 200 when the media cartridge 100 is mounted on the main body of the image recording apparatus. The couplings do not mutually engage in a state when the media cartridge 100 is mounted on the main body.

When the control portion 18 instructs the starting the sheet feeding operation after the ink supply operation to the recording head 12, the sheet feeding motor 201 is activated to move the drive shaft 203 toward the media cartridge 100, whereby the coupling 200*b* of the sheet feeding roller 200 engages with the coupling 202 provided on the drive shaft 203. Almost at the same time, the pressurizing member 220 is lowered to contact the uppermost sheet.

The engaging operation of the couplings and the lowering operation of the pressurizing member 220 are executed by rotating the sheet feeding motor 201 by a predetermined amount in a direction opposite to that in the sheet feeding operation. Upon contacting the uppermost sheet, the pressurizing member 220 gives a predetermined sheet feeding pressure to the sheet feeding roller 200, and awaits the start of rotation of the sheet feeding roller 200.

After the sheet feeding pressure is given by the pressurizing member 220, the sheet feeding motor 201 rotates the sheet feeding roller 200 in the sheet feeding direction, thereby advancing the lowermost sheet 1 through the aperture (slit) 110*b* formed in the lowest part of the impingement portion 110*a*. The sheet feeding pressure given by the pressurizing member 220 is determined according to the friction coefficient between the sheets, that between the sheet and the roller 200 and the feeding power of the sheet feeding roller 200.

When thus advanced sheet 1 starts to be conveyed by the conveying means in the image recording apparatus, the sheet feeding motor 201 is rotated in a direction opposite to the sheet feeding direction, thereby separating the pressurizing member from the uppermost sheet and returning it to the initial position, thus terminating the drive of the sheet feeding roller 200.

At the same time, the coupling 202 of the drive shaft 203 is moved to the initial position, in order to disengage the couplings. In this manner, while the sheet is conveyed by the conveying means, unnecessary feeding power is not supplied to other sheets in the sheet containing portion, thereby avoiding double feeding.

Other image recording operations are same as those in the foregoing embodiment and will not, therefore, be explained further.

The above-explained variation of the media cartridge 100 allows, in addition to the advantages of the present invention explained in the foregoing embodiment, to position the sheet feeding roller 200 in a space which is made available by the superposed positioning of the ink containing portion 104 and the sheet containing portion 103, thereby enabling to reduce the dimension of the media cartridge.

Also the sheet need not be provided with an engaging portion, so that the processing cost of the sheet can be lowered. Also the cost of the media cartridge 100 itself can be lowered, since the complex sheet feeding member 108 need not be constructed.

The present variation is so designed as to advance the sheets in succession from the lowermost one, because the sheet for image formation by ink discharge often bears a special coating thereon. More specifically, the contact of the coated sheet surface and the roller may result in peeling of the coating or smear of the sheet surface for example by deposition of paper dust. Such drawbacks can be avoided by advancing the sheet by contact of the roller with the rear surface of the sheet.

Also the slit separation method, employing the aperture 110*b* and advancing the sheets from the lowermost one, has the advantages of simplifying the cartridge and reducing the cost thereof, since the media cartridge 100 does not require therein a member for lifting the sheets 1 to a predetermined position.

As explained in the foregoing, the media cartridge 100 is to be re-used by replenishment of the sheet and the ink when they are consumed, and this variation enables cleaning of the smear or paper dust sticking to the sheet feeding roller 200 in such operation. Such cleaning is extremely difficult if the sheet feeding roller 200 is provided in the main body of the image recording apparatus. The presence of the sheet feeding roller 200 in the media cartridge 100 facilitates such cleaning operation.

As already explained in the foregoing, the sheet 1 contained in the media cartridge 100 for image recording may be different in the material, thickness, friction coefficient etc. Such different sheets, if fed by the feeding roller provided in the image recording apparatus, may result in defects such as slippage or double feeding because the feeding property is different for each sheet. Stated differently, if the sheet feeding roller is provided in the image recording apparatus, such roller cannot be replaced to a different material or a different roller diameter in order to cope with the difference in the kind of the image recording sheet, resulting from the replacement of the media cartridge, thereby eventually leading to the above-mentioned drawbacks.

However, in the configuration having the sheet feeding roller 200 in the media cartridge 100, the roller 200 can be selected so as to match the sheet 1 contained in such cartridge 100. It is thus made possible to select the material of the elastic member constituting the sheet feeding roller 200, thereby avoiding the above-mentioned drawbacks.

Also the positional precision can be improved since the sheet 1 and the sheet feeding roller 200 are housed in a single frame body.

The media cartridge explained in detail in the foregoing and the image recording apparatus capable of detachably mounting such media cartridge provide a mobile printing environment that cannot be attained with the conventional apparatus.

What is claimed is:

1. A media cartridge detachably mountable on an image recording apparatus for recording an image on a sheet and including a frame body, said frame body comprising:

sheets for recording an image in said image recording apparatus;

an ink containing member for containing ink to be supplied to image recording means of said image recording apparatus and to be discharged to said sheets;

pickup means for advancing said sheets one by one from said frame body; and an ink absorbent member for absorbing ink not used for the recording in said image recording apparatus in a state that said frame body is mounted on said image recording apparatus.

2. A media cartridge according to claim 1, wherein said frame body further includes a shutter member capable of sliding so as to expose said ink absorbent member to the exterior of said frame body by engaging said media cartridge with a main body of said image recording apparatus.

3. A media cartridge according to claim 1, wherein said media cartridge includes an exposed portion to be inserted below said image recording means upon mounting on said image recording apparatus, and said ink absorbent member is provided in said exposed portion.

4. A media cartridge according to claim 3, wherein said frame body further includes a shutter member capable of sliding so as to expose said exposed portion by engagement with said image recording apparatus when said media cartridge is mounted on said image recording apparatus.

5. A media cartridge according to claim 3, wherein said exposed portion includes a supply aperture for supplying the ink contained in said ink containing member to said image recording apparatus.

6. A media cartridge according to claim 3, wherein said ink absorbent member has a length in the direction of width larger than the width of the sheet contained in said frame body, and is provided in said exposed portion.

7. A media cartridge according to claim 3, wherein said ink absorbent member is positioned at least outside the conveying area of the sheets conveyed in said exposed portion.

8. A media cartridge according to claim 3, wherein said exposed portion serves also as a platen for supporting the sheet in an image recording operation by said image recording means.

9. A media cartridge according to claim 1, wherein said ink absorbent member is detachable from said frame body.

10. A media cartridge according to claim 1, wherein said ink absorbent member is comprised of a porous material formed by sintering an ink absorbent material.

11. A media cartridge according to claim 1, wherein said frame body includes a limiting guide for limiting lateral faces and sheet faces of the sheets contained in said frame body.

12. A media cartridge according to claim 1, wherein said frame body includes a sheet supporting plate for supporting the sheets contained in said frame body, and said sheet supporting plate serves also as a protective member for protecting said ink containing member.

13. A media cartridge according to claim 1, wherein said pickup means is adapted to advance a stack of the sheets in succession from the lowermost one of the stacked sheets in the direction of gravity from said frame body toward said image recording apparatus.

14. A media cartridge according to claim 13, wherein said pickup means includes a sheet feeding member for advancing the sheets and a separating portion for separating one of the sheets advanced by said sheet feeding member, wherein said separating portion is of a slit separation type for separating the sheets by an aperture allowing only one sheet to pass.

15. A media cartridge according to claim 14, wherein said separating portion includes an impingement portion for preventing feeding of plural sheets by impinging on sheets other than the lowermost one, and said impingement portion serves also as a guide for containing the sheets.

16. A media cartridge according to claim 14, wherein said sheet feeding member is comprised of a rotary feeding member positioned below the sheets contained in said frame body and successively advances the sheets by rotation while in contact with the lowermost sheet.

17. A media cartridge according to claim 16, wherein said rotary feeding member is provided with a coupling connected to a shaft supporting said rotary feeding member, and is rotated by transmission of driving power to said coupling.

18. A media cartridge according to claim 14, wherein said sheet feeding member is adapted to advance the sheets by engagement with an engaging portion formed in each sheet contained in said frame body.

19. A media cartridge according to claim 18, wherein said sheet feeding member is provided between said frame body and a lateral plate limiting lateral faces of the sheets contained in said frame body.

20. A media cartridge according to claim 19, wherein said sheet feeding member is provided at the leading end side of said sheets in the feeding direction thereof, and said engaging portion is formed in a position capable of engaging with said sheet feeding member.

21. A media cartridge according to claim 18, wherein said engaging portion formed in each sheet is formed by notching an end portion of each sheet so as to form a plane substantially parallel to a transverse direction of the sheet.

22. A media cartridge according to claim 18, wherein said engaging portion formed in each sheet is formed by notching an end portion of the sheet in a rectangular form.

23. A media cartridge according to claim 18, wherein said engaging portion formed in each sheet is formed by notching an end portion of the sheet in an approximately semicircular form.

24. A media cartridge according to claim 18, wherein said engaging portion formed in each sheet is an aperture formed in the sheet surface.

25. A media cartridge according to claim 24, wherein said aperture is formed as an approximately triangular aperture at the side of said sheet feeding member within said frame body.

26. A media cartridge according to claim 24, wherein said aperture is formed as an approximately rectangular aperture at the side of said sheet feeding member within said frame body.

27. A media cartridge according to claim 24, wherein said aperture is formed at the approximate center in the width of each sheet, and said sheet feeding member is provided at a position below said sheet and capable of engaging with said aperture.

28. A media cartridge according to claim 18, wherein said engaging portion formed in each sheet is a rack-shaped notch portion formed on an end of the sheet, and said sheet feeding member is an advancing gear for advancing the sheet by rotation in engagement with said notch portion.

29. A media cartridge according to claim 1, wherein said frame body includes conveying means for further conveying the sheets separated and advanced by said pickup means.

30. A media cartridge according to claim 29, wherein said conveying means is provided in the exposed portion to be inserted under said image recording means.

31. A media cartridge according to claim 29, wherein said conveying means is a pinch roller capable of rotation while supporting the sheets.

32. A media cartridge according to claim 29, wherein a biasing member for biasing said conveying means toward said image recording apparatus is provided under said conveying means.

33. A media cartridge according to claim 1, wherein the amount of the ink contained in said ink containing member is a minimum amount necessary for image recording on a maximum number of the sheets contained in said frame body.

34. A media cartridge according to claim 1, wherein, when sheets contained in said frame body are advanced by said pickup means and no longer exist in said frame body, sheets can be supplied again in said frame body.

35. A media cartridge according to claim 1, wherein, when said ink contained in said ink containing member is supplied to said image recording means and is consumed, the ink can be replenished again in said ink containing member.

36. A media cartridge according to claim 1, wherein said frame body contains said ink containing member in a replaceable manner.

37. A media cartridge according to claim 1, wherein said ink containing member contains inks of yellow, magenta and cyan colors.

38. A media cartridge according to claim 1, wherein said ink containing member is a flexible bag member.

39. An image recording apparatus comprising:

a) a mounting portion capable of detachably mounting a media cartridge comprised of a frame body including:
   sheets for recording an image in said image recording apparatus;
   an ink containing member for containing ink to be supplied to said image recording apparatus and to be discharged to said sheets;
   pickup means for advancing said sheets one by one from said frame body; and
   an ink absorbent member for absorbing ink not used for the recording in said image recording apparatus in a state that said frame body is mounted on said image recording apparatus;

b) image recording means for discharging ink supplied from said ink containing member to said sheets contained in said media cartridge;

c) drive means for activating said pickup means; and d) conveying means for conveying the sheets.

40. An image recording apparatus according to claim 39, wherein said frame body of said media cartridge further includes a shutter member capable of sliding so as to expose said ink absorbent member to the exterior of said frame body by engaging said frame body with a main body of said image recording apparatus.

41. An image recording apparatus according to claim 39, wherein said media cartridge includes an exposed portion to be inserted below said mounting portion of said image recording apparatus upon mounting on said mounting portion of said image recording apparatus, and said ink absorbent member is provided in said exposed portion.

42. An image recording apparatus according to claim 41, wherein said frame body further includes a shutter member capable of sliding so as to expose said exposed portion by engagement with a main body of said image recording apparatus when said media cartridge is mounted in said mounting portion of said image recording apparatus.

43. An image recording apparatus according to claim 41, wherein said exposed portion serves also as a platen for supporting the sheets in an image recording operation by said image recording means.

44. An image recording apparatus according to claim 41, wherein said exposed portion includes a supply aperture for supplying the ink contained in said ink containing member to said image recording means.

45. An image recording apparatus according to claim 44, wherein the ink supply from said supply aperture to said image recording means is executed by connection with said supply aperture by displacement of said image recording means toward said supply aperture.

46. An image recording apparatus according to claim 39, wherein said pickup means includes a sheet feeding member for advancing a stack of the sheets in succession from the lowermost one of the stacked sheets in the direction of gravity and a separating portion for separating one of the sheets advanced by said sheet feeding member, wherein said separating portion is of a slit separation type for separating the sheets by an aperture allowing only one sheet to pass.

47. An image recording apparatus according to claim 46, wherein said sheet feeding member is comprised of a rotary feeding member positioned below said sheets and successively advances the sheets by rotation while in contact with the lowermost sheet.

48. An image recording apparatus according to claim 47, wherein said rotary feeding member is provided with a coupling connected to a shaft supporting said rotary feeding member, and is rotated by transmission of driving power from said drive means to said coupling.

49. An image recording apparatus according to claim 48, wherein said drive means for driving said rotary feeding member is formed on said image recording apparatus and is capable of drive transmitting by mounting said media cartridge on said image recording apparatus.

50. An image recording apparatus according to claim 49, further including a pressing member for pressing the sheets contained in said frame body toward said rotary feeding member, and said pressing member is adapted, by said drive means, to displace between a position contacting the uppermost sheet contained in said frame body and a position separated from the sheet.

51. An image recording apparatus according to claim 50, wherein said frame body is provided with an aperture for exposing the upper surface of the uppermost sheet contained in said frame body when said media cartridge is mounted on said image recording apparatus, and said pressing member contacts said uppermost sheet through said aperture.

52. An image recording apparatus according to claim 51, wherein said aperture is so constructed as to be positioned substantially vertically above said rotary feeding member, and said pressing member is so positioned in said image recording apparatus, by mounting said media cartridge on said mounting portion, as to be substantially vertically above said aperture.

53. An image recording apparatus according to claim 46, wherein said sheet feeding member is adapted to advance the sheets by engagement with an engaging portion formed in each sheet contained in said frame body.

54. An image recording apparatus according to claim 53, wherein said sheet feeding member is adapted to feed each sheet by transmission of driving power from said drive means provided in a main body of said image recording apparatus.

55. An image recording apparatus according to claim 39, further including a pinch roller provided, when said media cartridge is mounted on said image recording apparatus, in a position opposed to said conveying means provided in said image recording apparatus and adapted to pinch and convey the sheets in cooperation with said conveying means.

56. An image recording apparatus according to claim 55, wherein a biasing member for biasing said conveying means toward said image recording apparatus is provided under said conveying means.

57. An image recording apparatus according to claim 39, further including a control portion for controlling said image recording apparatus and said media cartridge, wherein said control portion is adapted, in response to input of an image recording command, to execute control for supplying ink from said media cartridge to said image recording means, then control for activating said pickup means to feed the sheets thereby executing an image recording operation on said sheets.

58. An image recording apparatus according to claim 57, wherein the ink supplying operation from said media cartridge to said image recording means is executed for every image recording on a sheet.

59. An image recording apparatus according to claim 39, wherein said conveying means of said image recording apparatus is so constructed as to substantially linearly convey the sheets advanced from said media cartridge.

60. An image recording apparatus according to claim 39, wherein said image recording means includes an ink jet recording head for recording an image by discharging ink onto the sheets.

61. A media cartridge detachably mountable on an image recording apparatus provided with image recording means capable of discharging ink, the media cartridge including:

a frame body;

a sheet body comprising plural stacked sheets contained in said frame body;

a sheet feeding roller adapted to contact the outermost sheet surface of said sheet body thereby feeding the sheets one by one; and an ink containing member storing ink to be supplied to said image recording means, wherein said sheet feeding roller is positioned at the leading end side, in a sheet feeding direction, on the sheet surface of said sheet body, and said ink containing member is positioned at the sheet surface at the side of said sheet feeding roller and at the upstream side of said sheet feeding roller in the sheet feeding direction, both being contained in said frame body.

62. A media cartridge according to claim 61, wherein said ink containing member and said sheet feeding roller are contained in said frame body and positioned therein within a projected area of said sheets, observed from a direction perpendicular to a sheet surface on which the image is to be recorded.

63. A media cartridge according to claim 61, wherein, taking a face of said frame body at the side of said ink containing member as a bottom face, the height from said bottom face to the upper surface of said ink containing member is approximately same as the height from said bottom face to a position where said sheet feeding roller is in contact with the sheet body.

64. A media cartridge according to claim 61, wherein said frame body includes an ink absorbent member for absorbing ink not used for recording by said image recording means, and said ink absorbent member is provided in an exposed portion positioned at the downstream side of said sheet feeding roller in the sheet feeding direction in a state that said media cartridge is mounted on said image recording apparatus.

65. A media cartridge according to claim 64, wherein, taking a face of said frame body at the side of said ink containing member as a bottom face, the height of said exposed portion from said bottom face is smaller than the height from said bottom face to a position where said sheet feeding roller is in contact with the sheet body.

66. A media cartridge according to claim 64, wherein said frame body includes a shutter member adapted to cover said exposed portion, and said shutter member is slidable to expose said exposed portion by engaging with said image recording apparatus when said media cartridge is mounted on said image recording apparatus.

67. A media cartridge according to claim 64, wherein said exposed portion is positioned below said image recording means when said media cartridge is mounted on said image recording apparatus.

68. A media cartridge according to claim 61, wherein said frame body includes a limiting guide for limiting lateral faces and the surfaces of the sheets contained in said frame body.

69. A media cartridge according to claim 61, wherein said frame body includes a sheet supporting plate for supporting the sheets contained in said frame body, and said sheet supporting plate is positioned between said sheet body and said ink containing member thereby serving also as a protective member for protecting said ink containing member.

70. A media cartridge according to claim 61, wherein said sheet feeding roller is adapted for advancing the sheets in succession from the lowermost sheet of said sheet body in the direction of gravity from said frame body to said image recording apparatus.

71. A media cartridge according to claim 70, wherein said frame body includes a separating portion for separating one of the sheets at the leading end side thereof in the sheet feeding direction, wherein said separating portion is of a slit separation type for separating the sheets by an aperture allowing only one sheet to pass.

72. A media cartridge according to claim 71, wherein said separating portion includes an impingement portion, at the downstream side of said sheets contained in said frame body in the sheet feeding direction, for preventing feeding of plural sheets by impinging on sheets other than the lowermost one, and said impingement portion serves also as a guide for containing the sheets in said frame body.

73. An image recording apparatus comprising:

a media cartridge according to any one of claims 61 to 72; and conveying means for conveying a sheet fed from said media cartridge when said media cartridge is mounted on said image recording apparatus.

74. A media cartridge according to claim 61, wherein said image recording means includes an ink jet recording head for forming an image by discharging ink.

75. A media cartridge detachably mountable on an image recording apparatus for forming an image on a sheet, the media cartridge comprising:

a frame body;

a sheet containing portion provided in said frame body and adapted for containing sheets for recording an image in said image recording apparatus;

an ink containing portion provided in said frame body and adapted for containing an ink containing member containing ink to be supplied to image recording means of said image recording apparatus and to be discharged onto said sheets;

pickup means provided in said frame body and adapted to feed said sheets one by one from said frame body; and an ink absorbent member containing portion provided in said frame body and containing an ink absorbent member for absorbing the ink not used in said image recording means in a state that said frame body is mounted on said image recording apparatus.

76. A media cartridge according to claim 75, wherein said frame body includes a shutter member slidable to expose said ink absorbent member to the exterior of said frame body by engaging with a main body of said image recording apparatus.

77. A media cartridge according to claim 75, further comprising an exposed portion to be positioned below said image recording means when said media cartridge is mounted on said image recording apparatus, and said ink absorbent member containing portion is provided in said exposed portion.

78. A media cartridge according to claim 77, wherein said frame body further includes a shutter member capable of sliding so as to expose said exposed portion by engagement with said image recording apparatus when said media cartridge is mounted on said image recording apparatus.

79. A media cartridge according to claim 77, wherein said exposed portion includes a supply aperture for supplying the ink contained in said ink containing member contained in said ink containing portion to said image recording means.

80. A media cartridge according to claim 77, wherein said ink absorbent member has a length larger than the width of the sheets contained in said sheet containing portion, and is provided in said exposed portion.

81. A media cartridge according to claim 77, wherein said ink absorbent member is positioned at least outside a conveying area of the sheets conveyed in said exposed portion.

82. A media cartridge according to claim 77, wherein said exposed portion serves also as a platen for supporting the sheets in an image recording operation by said image recording means.

83. A media cartridge according to claim 77, wherein the amount of the ink contained in said ink containing member is a minimum amount necessary for image recording on a maximum number of the sheets contained in said frame body.

84. A media cartridge according to claim 75, wherein said ink absorbent member is detachable from said frame body.

85. A media cartridge according to claim 75, wherein said ink absorbent member is comprised of a porous material formed by sintering an ink absorbent material.

86. A media cartridge according to claim 75, wherein said frame body includes a limiting guide for limiting the lateral faces and upper surfaces of the sheets contained in said sheet containing portion.

87. A media cartridge according to claim 75, wherein said frame body includes a sheet supporting plate for supporting the sheets contained in said sheet containing portion, and said sheet supporting plate serves also as a protective member for protecting said ink containing member contained in said ink containing portion.

88. A media cartridge according to claim 75, wherein said pickup means is adapted to feed a stack of the sheets in succession from the lowermost one of the stacked sheets in the direction of gravity, from said sheet containing portion toward said image recording apparatus.

89. A media cartridge according to claim 88, wherein said pickup means includes a sheet feeding member for feeding the sheets from said sheet containing portion and a separating portion for separating one of the sheets fed by said sheet feeding member, wherein said separating portion is of a slit separation type for separating the sheets by an aperture allowing only one sheet to pass.

90. A media cartridge according to claim 89, wherein said separating portion includes an impingement portion for preventing feeding of plural sheets by impinging the sheets contained in said sheet containing portion other than the lowermost one, and said impingement portion serves also as a sheet containing guide for said sheet containing portion.

91. A media cartridge according to claim 89, wherein said sheet feeding member is comprised of a rotary feeding member positioned below said sheet containing portion for feeding the sheets by rotation while in contact with the lowermost sheet.

92. A media cartridge according to claim 91, wherein said rotary feeding member is provided with a coupling connected to a shaft supporting said rotary feeding member, and is rotated by transmission of driving power to said coupling.

93. A media cartridge according to claim 92, wherein said sheet feeding member is provided between said frame body and a lateral plate of said sheet containing portion.

94. A media cartridge according to claim 89, wherein said sheet feeding member is adapted to feed the sheets by engagement with an engaging portion formed in each sheet contained in said sheet containing portion.

95. A media cartridge according to claim 94, wherein said engaging portion formed in each sheet is formed by notching an end portion of each sheet so as to form a plane substantially parallel to a transverse direction of the sheets.

96. A media cartridge according to claim 94, wherein said engaging portion formed in each sheet is formed by notching an end portion of each sheet in a rectangular form.

97. A media cartridge according to claim 94, wherein said engaging portion formed in each sheet is formed by notching an end portion of each sheet in an approximately semicircular form.

98. A media cartridge according to claim 94, wherein said sheet feeding member is provided at the leading end side of said sheets in the feeding direction thereof, and said engaging portion is formed in a position capable of engaging with said sheet feeding member.

99. A media cartridge according to claim 94, wherein said engaging portion formed in each sheet is an aperture formed in the sheet surface.

100. A media cartridge according to claim 99, wherein said aperture is formed as an approximately triangular aperture at the side of said sheet feeding member within said frame body.

101. A media cartridge according to claim 99, wherein said aperture is formed as an approximately rectangular aperture at the side of said sheet feeding member within said frame body.

102. A media cartridge according to claim 99, wherein said aperture is formed at the approximate center in the width of each sheet, and said sheet feeding member is provided at a position below said sheets and capable of engaging with said aperture.

103. A media cartridge according to claim 94, wherein said engaging portion formed in each sheet is a rack-shaped notch portion formed on an end of each sheet, and said sheet feeding member is an advancing gear for advancing each sheet by rotation in engagement with said notch portion.

104. A media cartridge according to claim 75, wherein said frame body includes conveying means for further conveying the sheets separated and fed by said pickup means.

105. A media cartridge according to claim 104, wherein said conveying means is provided in an exposed portion to be positioned under said image recording means.

106. A media cartridge according to claim 104, wherein said conveying means is a pinch roller capable of rotation while supporting the sheets.

107. A media cartridge according to claim 104, wherein a biasing member for biasing said conveying means toward said image recording apparatus is provided under said conveying means.

108. A media cartridge according to claim 75, wherein, when the sheets contained in said frame body are advanced by said pickup means and no longer exist in said frame body, sheets can be supplied again in said frame body.

109. A media cartridge according to claim 75, wherein, when said ink contained in said ink containing member is supplied to said image recording means and is consumed, the ink can be replenished again in said ink containing member.

110. A media cartridge according to claim 75, wherein said frame body contains said ink containing member in replaceable manner.

111. A media cartridge according to claim 75, wherein said ink containing member contains inks of yellow, magenta and cyan colors.

112. A media cartridge according to claim 75, wherein said ink containing member is a flexible bag member.

* * * * *

UNITED STATES PATENT AND TRADEMARK OFFICE

CERTIFICATE OF CORRECTION

PATENT NO. : 6,523,933 B1
DATED : February 25, 2003
INVENTOR(S) : Hirano et al.

It is certified that error appears in the above-identified patent and that said Letters Patent is hereby corrected as shown below:

Column 26,
Lines 46-54, should be deleted.

Column 27,
Lines 8-67, should be deleted.

Column 28,
Lines 1-67, should be deleted.

Column 29,
Lines 1-13, should be deleted.

Column 30,
Lines 1-11, should be deleted.

Signed and Sealed this

Ninth Day of September, 2003

JAMES E. ROGAN
*Director of the United States Patent and Trademark Office*